US007165677B2

(12) United States Patent
Tanaka et al.

(10) Patent No.: US 7,165,677 B2
(45) **Date of Patent: *Jan. 23, 2007**

(54) STRUCTURE OF AIR-PACKING DEVICE

(75) Inventors: Yasuzumi Tanaka, Kawasaki (JP); Katsutoshi Yoshifusa, Lake Forest, CA (US)

(73) Assignee: Air-Paq, Inc.CA (US)

( * ) Notice: Subject to any disclaimer, the term of this patent is extended or adjusted under 35 U.S.C. 154(b) by 253 days.

This patent is subject to a terminal disclaimer.

(21) Appl. No.: 10/914,823

(22) Filed: Aug. 10, 2004

(65) Prior Publication Data

US 2006/0032779 A1 Feb. 16, 2006

(51) Int. Cl.
*B65D 81/02* (2006.01)

(52) U.S. Cl. ..... 206/522; 383/3

(58) Field of Classification Search ..... 206/522, 206/591, 592, 594; 383/3, 66, 37, 87
See application file for complete search history.

(56) References Cited

U.S. PATENT DOCUMENTS 5,427,830 A * 6/1995 Pharo ..... 428/35.2
5,826,723 A * 10/1998 Jaszai ..... 206/522
5,857,571 A 1/1999 Tschantz et al.
5,901,850 A 5/1999 Jones et al.
5,996,798 A 12/1999 Gessert
6,076,677 A 6/2000 Pozzo
6,464,079 B1 10/2002 Newman
6,629,777 B1 10/2003 Tanaka et al.
6,722,502 B1 4/2004 Newman
6,913,803 B1 * 7/2005 Peper ..... 428/35.2
7,000,767 B1 * 2/2006 Tanaka et al. ..... 206/522

* cited by examiner

*Primary Examiner*—Jila M. Mohandesi
(74) *Attorney, Agent, or Firm*—Muramatsu & Associates

(57) ABSTRACT

An air-packing device has an improved shock absorbing capability to protect a product in a container box. The air-packing device is configured by first and second plastic films which are bonded at predetermined portions thereby creating a plurality of air containers, each of the air containers having a plurality of series connected air cells; a plurality of check valves established at inputs of the corresponding air containers for allowing compressed air to flow only in a forward direction; and an air input commonly connected to the plurality of check valves. Through a post heat-seal treatments, predetermined edge portions are bonded, thereby creating an inner space for packing a product therein and an opening for loading the product therethrough.

15 Claims, 19 Drawing Sheets

STRUCTURE OF AIR-PACKING DEVICE

FIELD OF THE INVENTION

This invention relates to a structure of an air-packing device for use as packing material, and more particularly, to a structure of an air-packing device and check valves incorporated therein for achieving an improved shock absorbing capability to protect a product from a shock or impact occurred in a product distribution process.

BACKGROUND OF THE INVENTION

In a distribution channel such as product shipping, a styroform packing material has been used for a long time for packing commodity and industrial products. Although the styroform package material has a merit such as a good thermal insulation performance and a light weight, it has also various disadvantages: recycling the styroform is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter "air-packing device"). The air-packing device has excellent characteristics to solve the problems involved in the styroform. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 20 includes a plurality of air containers 22 and check valves 24, a guide passage 21 and an air input 25. The air from the air input 25 is supplied to the air containers 22 through the guide passage 21 and the check valves 24. The air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are intact.

FIG. 2 is a plan view of the air-packing device 20 of FIG. 1 when it is not inflated showing bonding areas for closing two thermoplastic films. The thermoplastic films of the air-packing device 20 are bonded (heat-sealed) together at bonding areas 23*a* which are rectangular periphery thereof to air tightly close the air-packing device. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two rectangular thermoplastic valve films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, etc. that need special attention so as not to receive a shock, vibration or other mechanical impact. Thus, there is also a need of air-packing devices that match with the particular shape of the product and can easily pack the products.

SUMMARY OF THE INVENTION

It is, therefore, an object of the present invention to provide a structure of an air-packing device for packing a product that can minimize a mechanical shock or vibration to the product by covering the whole product.

It is another object of the present invention to provide a structure of a check valve for the air-packing device that can reliably prevent reverse flow of the air in the air containers of the air-packing device.

It is a further object of the present invention to provide a structure of a check valve for the air-packing device that can be attached to any positions of the air-packing device.

It is a further object of the present invention to provide a structure of a check valve for the air-packing device that can enable to inflate the air-packing device with relatively low air pressure.

In one aspect of the present invention, the air-packing device for protecting a product therein is comprised of first and second thermoplastic films superposed with each other where predetermined portions of the first and second thermoplastic films are bonded, thereby creating a plurality of air containers, each of the air containers having a plurality of series connected air cells; a plurality of check valves established at inputs of the corresponding air containers between the first and second thermoplastic films for allowing the compressed air to flow in a forward direction, the check valve being attached to only one of the first and second thermoplastic films; an air input commonly connected to the plurality of check valves to supply the compressed air to all of the series connected air cells through the check valves. Through a post heat-seal treatment, predetermined edge portions of the air-packing device are bonded with one another after being folded, thereby creating an inner space for packing a product therein and an opening for loading the product therethrough.

The first type of check valve is preferably formed by sealed portions which are fixed to one of the first and second thermoplastic films. The seal portions include: an inlet portion which introduces the air into the check valve; a pair of narrow down portions creating a narrow down passage connected to the inlet portion; an extended portion which diverts the air flows coming through the narrow down passage; and a plurality of outlet portions which introduce the air from the extended portion to the air container.

Second type of check valve is preferably comprised of: a check valve film on which peeling agents of predetermined pattern are printed, said check valve film being attached to one of the first and second thermoplastic films; an air input established by one of the peeling agents on the air-packing device for receiving air from an air source; an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells. Heat-sealing between the first and second thermoplastic films for separating two adjacent air containers is prevented in a range where the peeling agent is printed.

The air input and the first type of check valves are formed at one end of the air-packing device where the air from the air input is supplied to the series connected air cells in a direction toward another end of the air-packing device through the check valves. The second type of the check valves are formed at any desired position on the air-packing device where the air from the check valve flows in both forward and backward directions in the air container to fill all of the series connected air cells therein.

The opening for loading the product is configured by two longitudinal ends which meet to one another after the air-packing device being folded. Alternatively, the opening for loading the product is configured by a predetermined portion of one of side edges of the air-packing device which is prohibited from being heat-sealed in said post heat-seal treatment. A film or paint having high heat resistance is provided at the predetermined portion of one of side edges to prohibit the predetermined portion from being heat-sealed in the post heat-seal treatment, thereby creating the opening for loading the product.

According to the present invention, the air-packing device can minimize a mechanical shock or vibration to the product when the product is dropped or collided. The sheet form of the air-packing device is folded and the post heat-seal treatment is applied thereto, thereby creating a structure unique to a production to be protected. The check valves in the air-packing device have a unique structure for preventing reverse flows of the air. The air-packing device of the present invention has a relatively simple structure with reliable check valves, it is able to provide a reliable air-packing device at low cost.

BRIEF DESCRIPTION OF THE DRAWINGS

FIG. 3A is a plan view showing a sheet like shape of the air-packing device and FIGS. 3B and 3C are cross sectional side views of the air-packing device which is folded to create a unique shape to wrap around a product,to be protected.

FIG. 12A is a plan view showing a structure of a check valve on an air-packing device, FIG. 12B is a plan view showing the check valve including flows of air indicated by dotted arrows when a compressed air is supplied to an air input, FIG. 12C is a plan view showing the heat-seal portions for bonding the check valve sheet to one of plastic films of the air-packing device, and FIG. 12D is a plan view showing the heat-seal portions for bonding the check valve sheet and the two plastic films of the air-packing device.

DETAILED DESCRIPTION OF THE INVENTION

The air-packing device of the present invention will be described in more detail with reference to the accompanying drawings. It should be noted that although the present invention is described for the case of using air for inflating the air-packing device for an illustration purpose, other fluids such as other types of gas or liquid can also be used.

The air-packing device is typically used in a container box to pack a product during the distribution flow of the product.

The air-packing device of the present invention is especially useful for packing a product which is sensitive to shock or vibration such as a personal computer, DVD driver, etc, having high precision mechanical components such as a hard disc driver. Other examples of such products include wine bottles, glassware, ceramic ware, music instruments, paintings, antiques, etc. The air-packing device reliably wraps the product within a space created by folding and applying a post heat-sealing treatment, thereby absorbing the shocks and impacts to the product when, for example, the product is inadvertently dropped on the floor or collided with other objects.

The air-packing device of the present invention includes a plurality of air containers each having a plurality of series connected air cells. The air container is air-tightly separated from the other air containers while the air cells in the same air container are connected by the air passages. Each air cell in the air container has a sausage like shape when inflated.

More specifically, two or more air cells are connected through air passages to form a set (air container) of series connected air cells. Each set of series connected air cells has a check valve, typically at an input area to supply the air to all of the series connected air cells while preventing a reverse flow of the compressed air in the air cell. Further, two or more such sets (air containers) having series connected air cells are aligned in parallel with one another so that the air cells are arranged in a matrix manner.

Figure 3A:
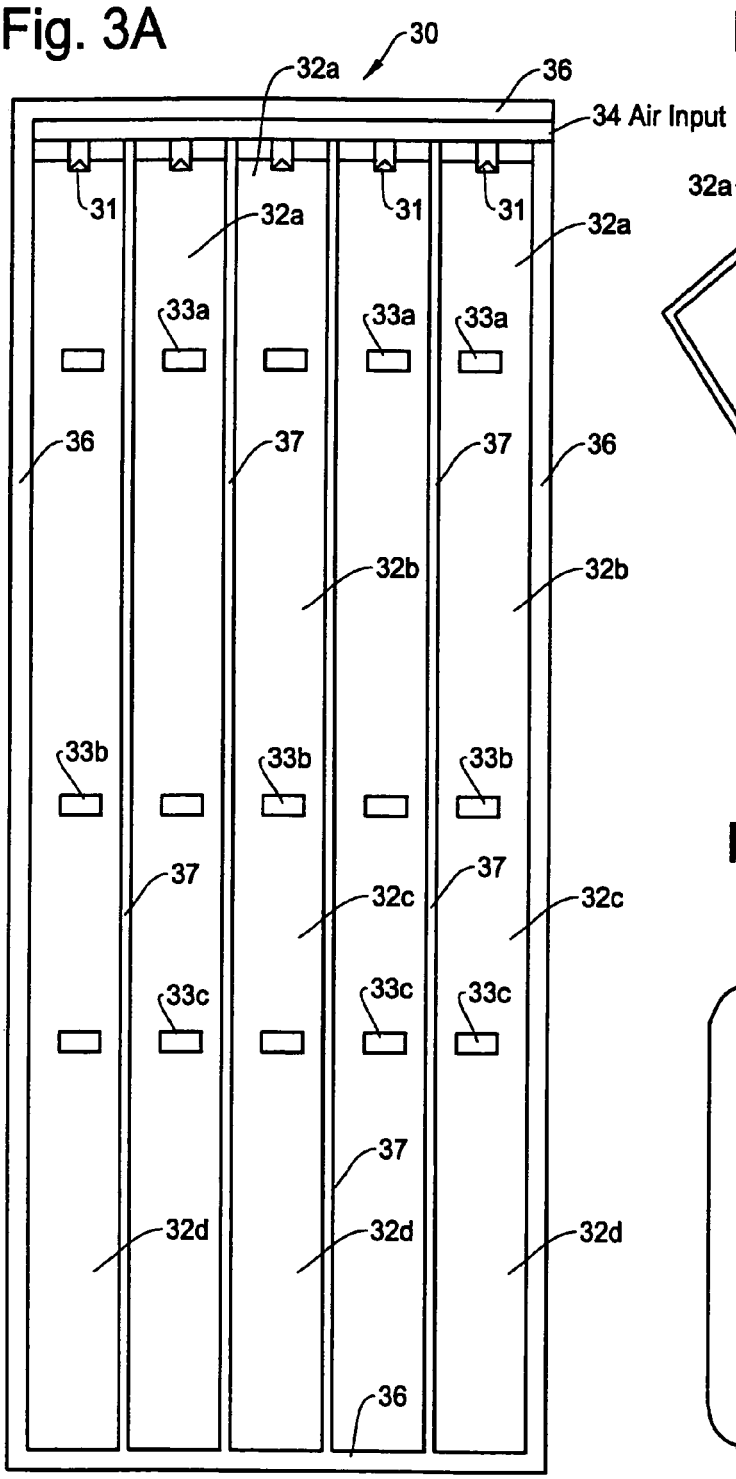
FIGS. 3A–3C show a basic concept of the air-packing device of the present invention where
Figure 3B:
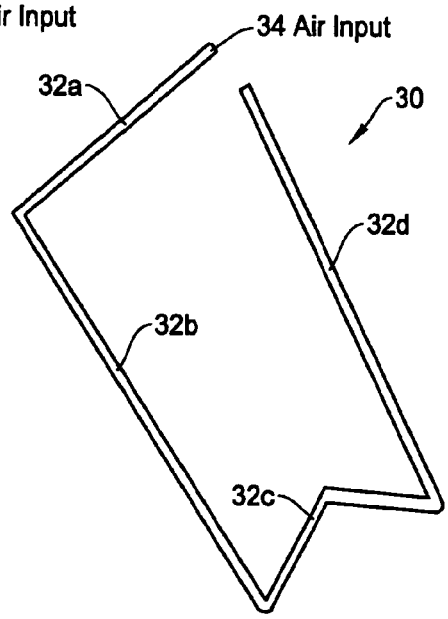
Figure 3C:
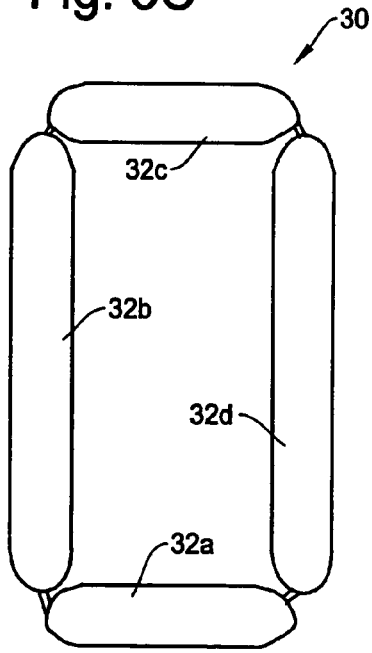

FIGS. 3A–3C show an example of the air-packing device of the present invention having a plurality of air containers each having plural sets of series connected air cells. FIG. 3A is a plan view showing a sheet like form of the air-packing device before being folded or inflated by the air for packing a particular product. FIG. 3B is a side view of the air-packing device which can be freely changed in shape by folding and heat-sealing so as to wrap a product therein. FIG. 3C is a cross sectional side view of the air-packing device which is inflated by the compressed air after the folding and heat-sealing processes.

Figure 1:
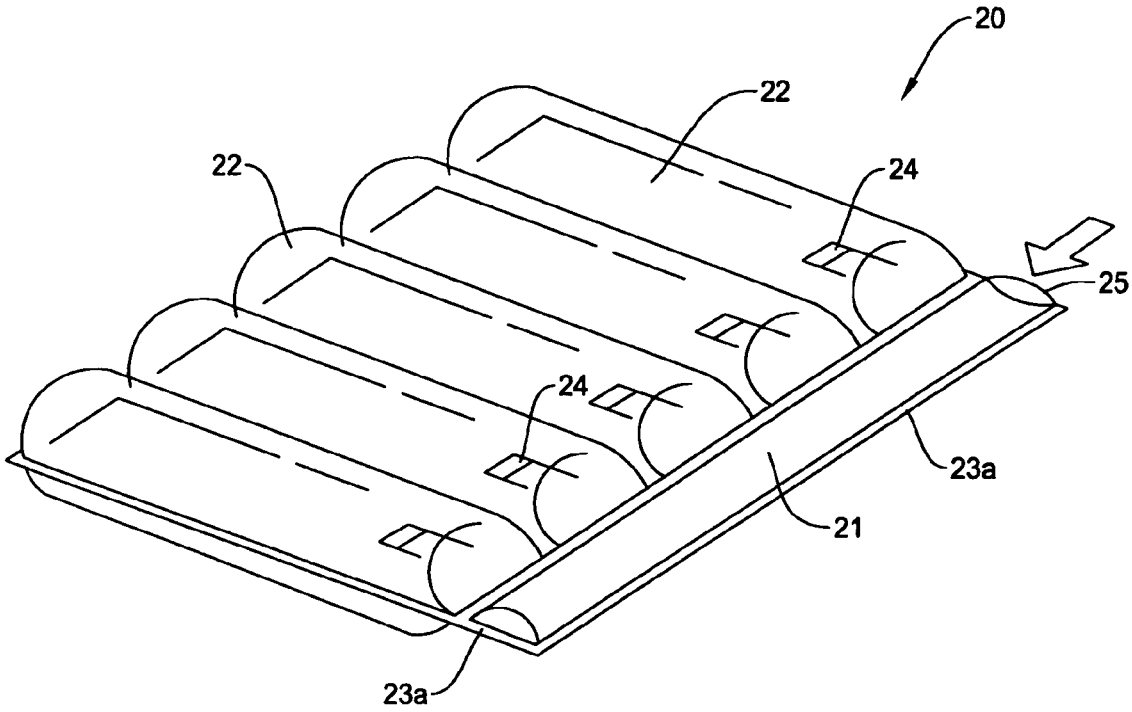
Fig. 1 (Prior Art)
FIG. 1 is a schematic perspective view showing an example of basic structure of an air-packing device in the conventional technology.
Figure 2:
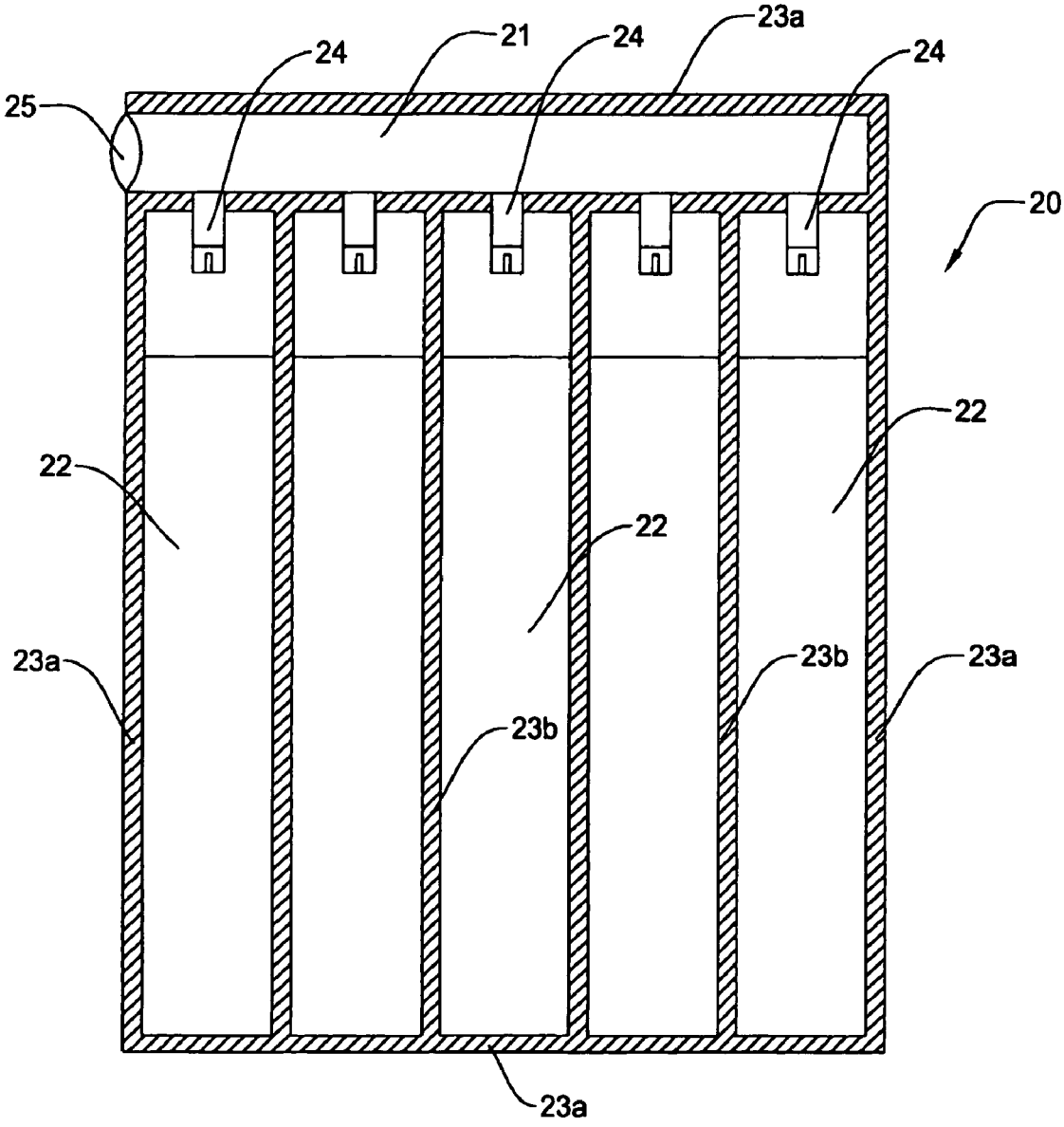
Fig. 2 (Prior Art)
FIG. 2 is a plan view of the air-packing device 20 of FIG. 1 when it is not inflated for showing bonding areas for closing two thermoplastic films.

As shown in FIG. 3A, the air-packing device 30 has multiple sets (air containers) of air containers arranged in parallel with one another where each air container has series connected air cells. As described with reference to FIGS. 1 and 2 and as will be described in more detail later, the air-packing device 30 is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 36 and each boundary 37 between the two sets (air containers) of series connected air cells after the check valve sheet is provided therebetween. Further, the first and second thermoplastic films are heat-sealed together at each heat-seal land 33.

Therefore, each set (air container) of series air cell is air-tightly separated from the other sets (air containers) of series air cells where each set has multiple air cells 32*a*–32*d* which are series connected to one another. At an input of each set of series connected air cells, a check valve 31 is provided to supply the air to the series of air cells 32*a*–32*d* through the air passages formed at the sides of the heat-seal lands 33. The check valves 31 are commonly connected to an air input 34. Thus, when the compressed air is supplied to the air input 34, the air cells 32*a*–32*d* in each series set will be inflated. Because of the check valves 31 which prohibit the reverse flow of the air, the air cells 32 remain inflated thereafter.

Before inflating the air, the air-packing device 30 of the present invention can be folded to match the outer shape of a particular product to be protected. Thus, in the example shown in the side view of FIG. 3B, the air-packing device 30 is so folded to wrap around the product (not shown). Typically, after folding the air-packing device 30, a post heat-seal treatment is applied thereto to bond the upper and lower ends together (FIG. 3A).

Thus, after supplying the air, the air-packing device 30 forms an inner space for receiving a product to be protected as shown in the side view of FIG. 3C. Typically, the product packed by the air-packing device 30 is further installed in a container box such as a corrugated carton. Thus, the air-packing device in the container box protects the product from the shock, vibration or other impact that may arise during the distribution process of the product.

Figure 4A:
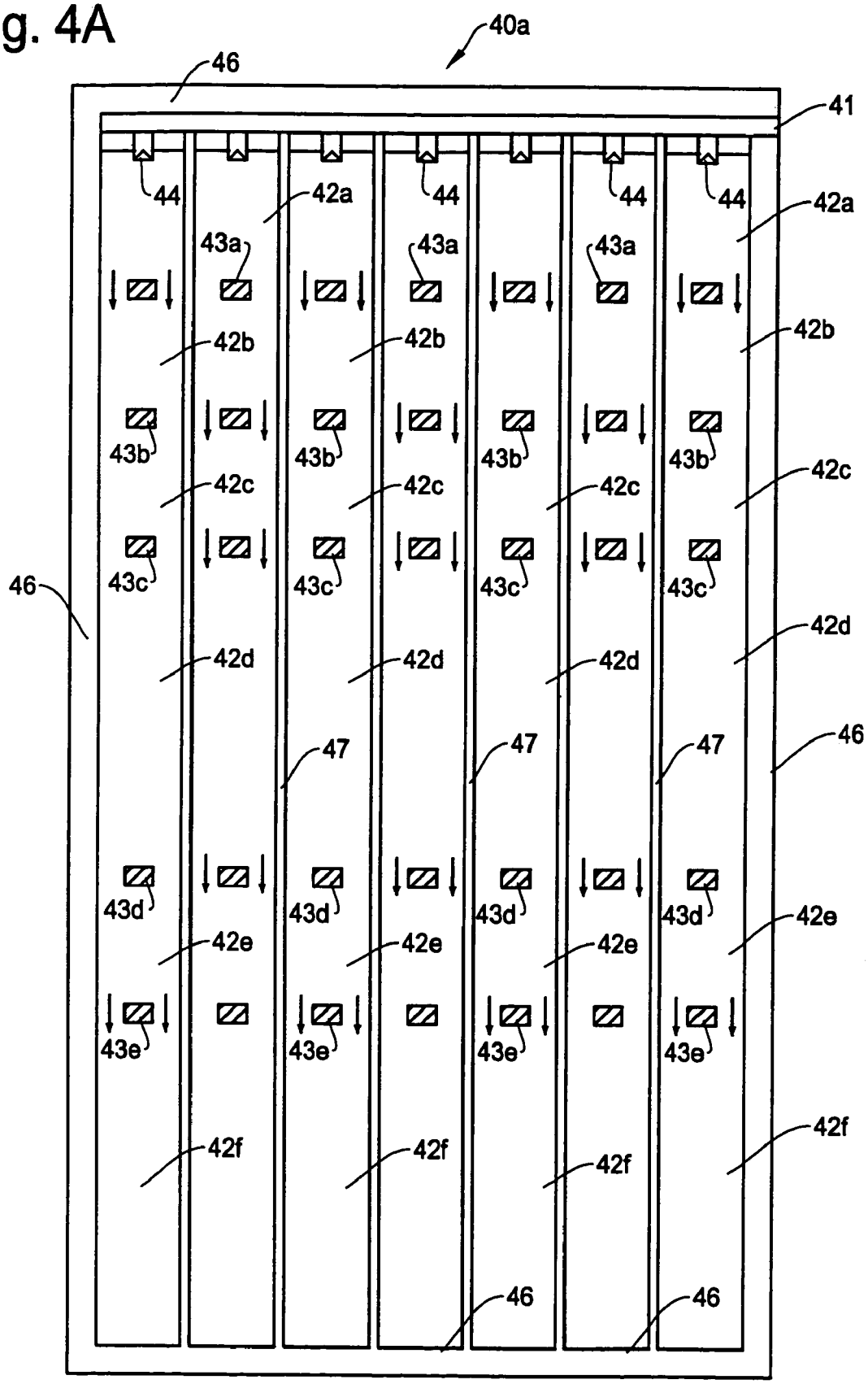
FIGS. 4A and 4B are plan views each showing a sheet like structure of the air-packing device before folding and applying a post heat-sealing process for creating generally square shape of the air packing device of FIGS. 6A an 6B, respectively.
Figure 6A:
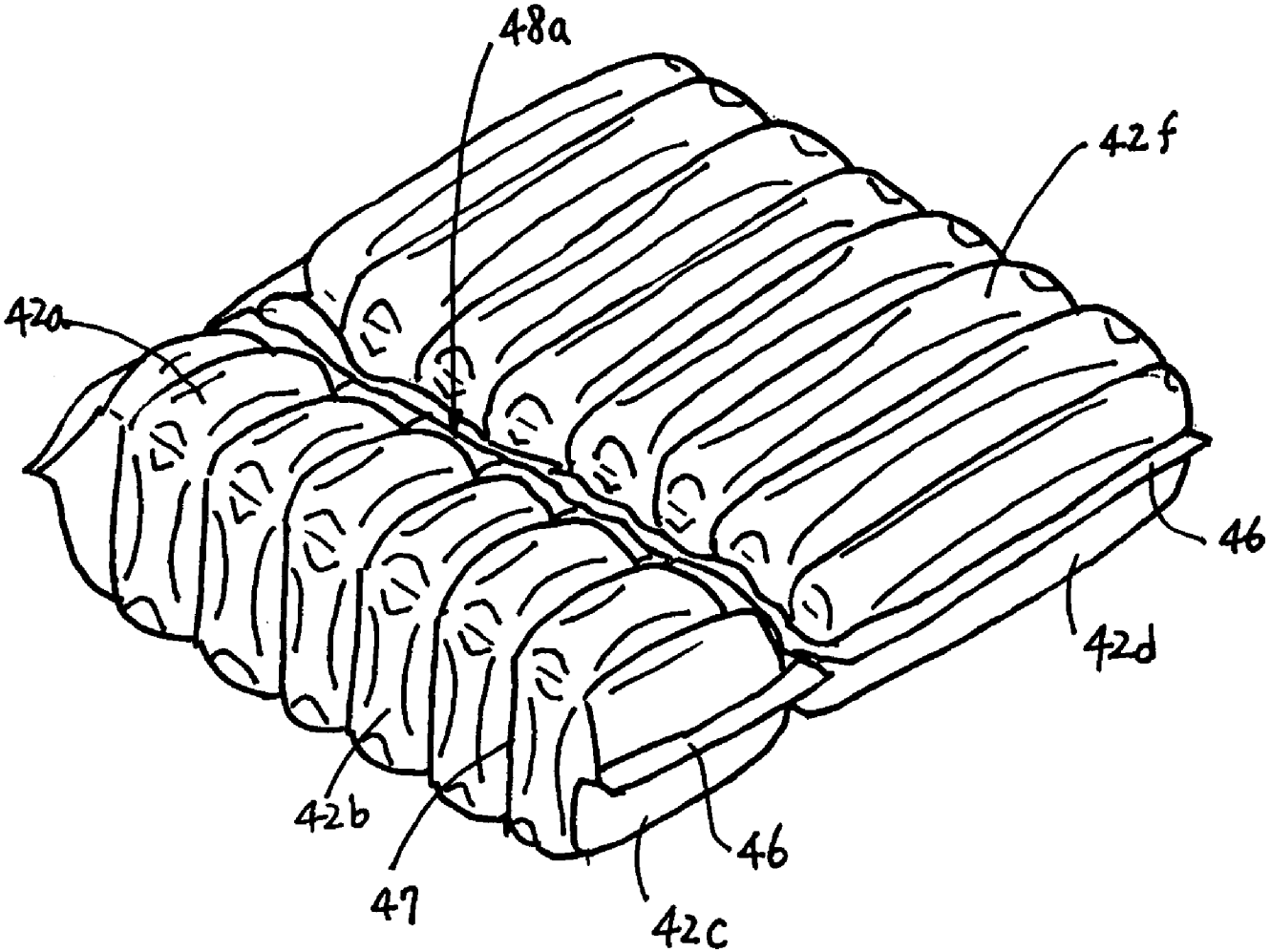
FIGS. 6A and 6B are perspective views showing examples of structure of the air-packing device in the present invention where the air-packing device of FIG. 6A corresponds to that of FIGS. 4A and 5A and the air-packing device of FIG. 6B corresponds to that of FIGS. 4B and 5B, respectively.

FIG. 4A is a plan view showing a sheet like structure of the air-packing device before folding and applying a post heat-sealing process for creating a generally square shape of the air-packing device of FIG. 6A. As will be described later, the air-packing device of FIG. 6A has a slit for loading a product therein formed by an upper end and a lower end, i.e., two longitudinal ends of the air-packing device 40*a* of FIG. 4A. Such a loading slit is formed on an upper (lower) surface of the air-packing device 40*a* of FIG. 6A by not heat-sealing the upper and lower ends in the post heat-seal process.

As shown in FIG. 4A, the air-packing device 40*a* has many sets of air containers each having a check valve 44 and series connected air cells 42*a*–42*f*. An example of structure of the check valve 44 is shown in FIGS. 9, 10A–10B and 11 which will be described in detail later. An air input 41 is commonly connected to all of the check valves 44 so that the air is supplied to each set of air cells 42*a*–42*f* through the check valve 44.

Similar to the example of FIG. 3, and as will be described in more detail later, the air-packing device 40*a* is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 46 and each boundary 47 between two sets of series connected air cells after the check valve sheet is inserted therein.

The first and second thermoplastic films are also heat-sealed at locations (heat-seal lands) 43*a*–43*e* for folding the air-packing device. Thus, the heat-seal lands 43*a*–43*e* close the first and second thermoplastic films at their locations but still allow the air to pass toward the next air cells as shown by the arrows at both sides of each heat-seal land 43. Since the portions at the heat-seal lands 43 are closed, each air container 42 is shaped like a sausage when inflated. In other words, the air-packing device 40*a* can be easily bent or folded at the heat-seal lands 43 to create the shape that fits to the product to be protected.

Figure 4B:
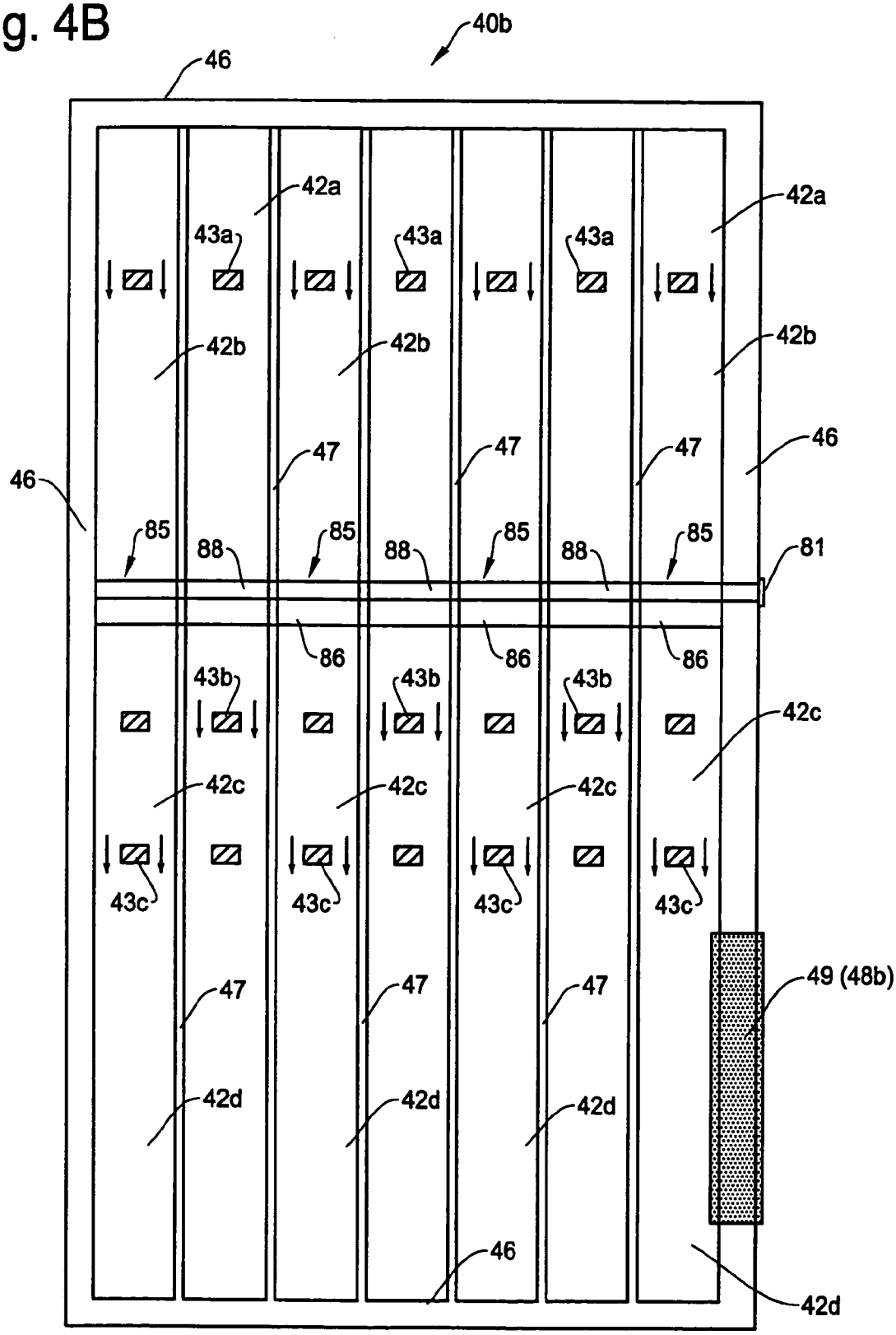
Figure 6B:
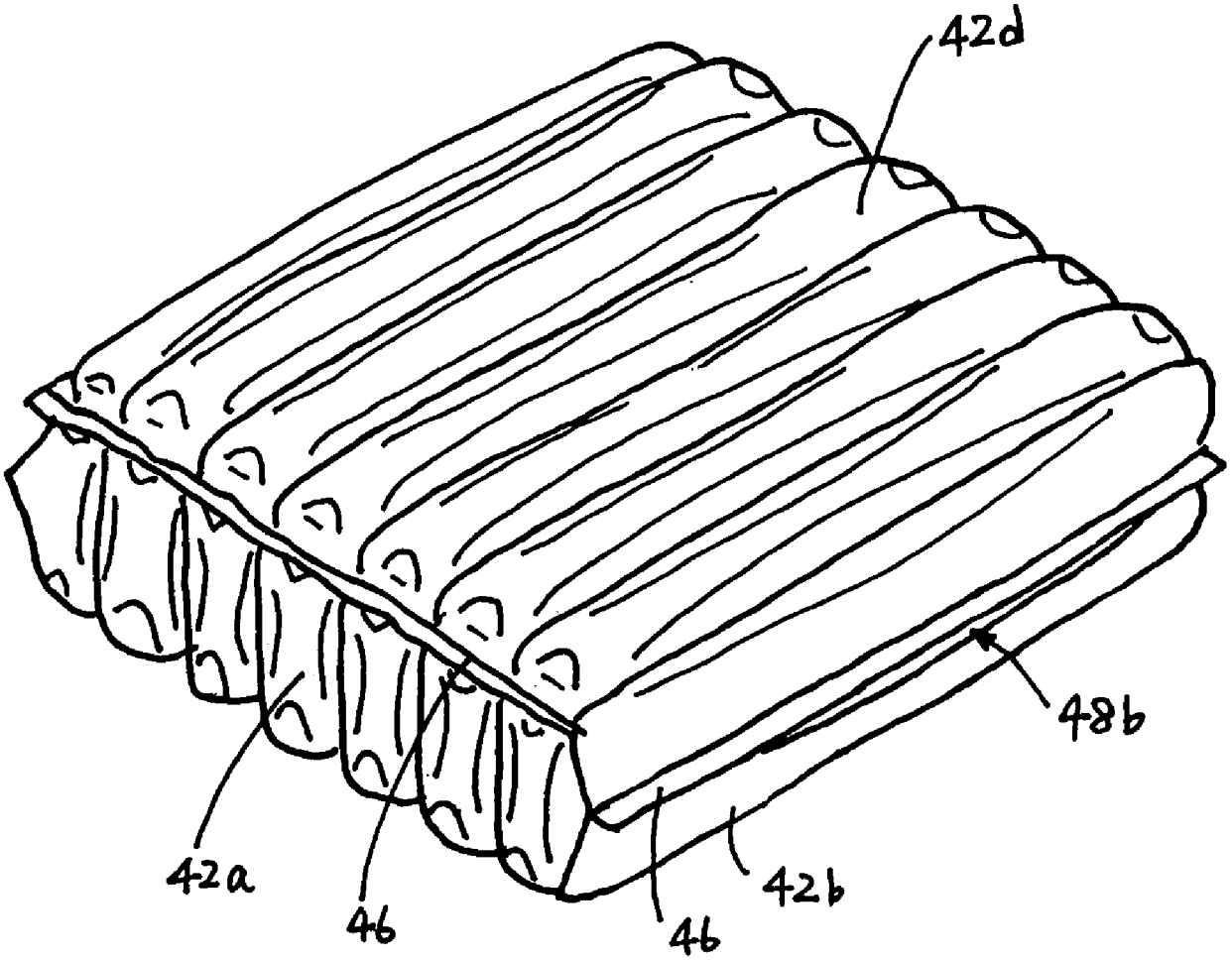

FIG. 4B is a plan view showing a sheet like structure of the air-packing device before folding and applying a post heat-sealing process for creating a generally square shape of the air packing device of FIG. 6B. As will be described later, the air-packing device of FIG. 6B has a slit for loading a product therein formed by incorporating a film for prohibiting the thermal bonding at one edge of the air-packing device 40*b* of FIG. 4B. Such a loading slit is formed on a side surface of the air-packing device 40*b* by not heat-sealing a part of the side edge in the post heat-seal process.

In this example, elements identical to that of FIG. 4A are denoted by the same reference numbers. As shown in FIG. 4B, the air-packing device 40*b* has many sets of air containers each having series connected air cells 42*a*–42*d*. Check valves 85 are provided on the air-packing device 40*b* at any desired locations thereof. A film 49 is provided on the side edge 46 to prohibit the bonding of the side edge 46 in the post heat-seal process for forming an opening 48*b* for loading the product (loading slit). Such a film for prohibiting the bonding can be made of high heat resistance material such as a Teflon film or a Mylar film. Further, a type of paint (peeling agent) that is able to interfere the bonding between the two thermoplastic films can also be used. An example of structure of the check valve 85 is shown in FIGS. 12A–12D, 13–14 and 15A–15B which will be described in detail later. An air input 81 is commonly connected to the first check valve 85 so that the air is supplied to each set of air cells 42–42*d*.

Figure 5B:
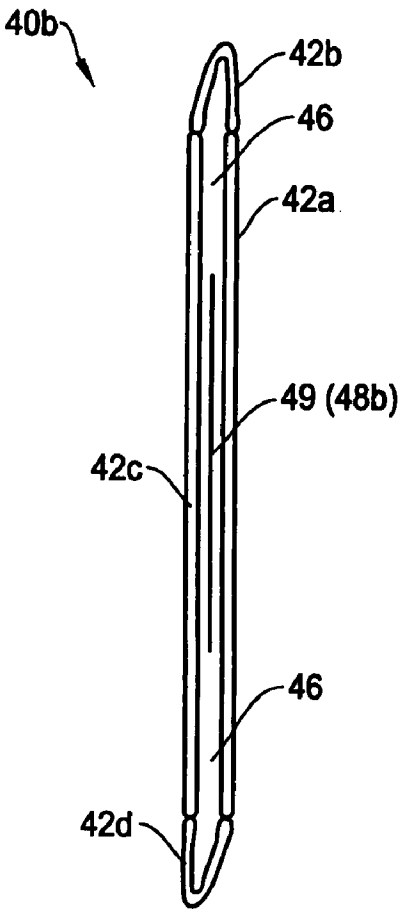
FIGS. 5A and 5B are side views showing a post-heat sealing process for forming the air-packing devices of FIGS. 6A and 6B, respectively, from the sheet like shapes of FIGS. 4A and 4B.
Figure 5A:
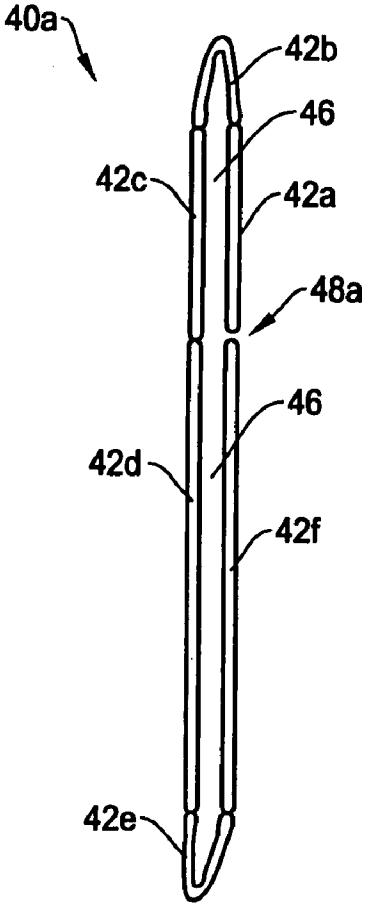

FIG. 5A is a side view of the air-packing device 40*a* involved in the post-heat sealing process for forming the air-packing device of FIG. 6A from the air-packing device in the sheet like shape shown in FIG. 4A. The sheet form of the air-packing device 40*a* is folded and the edges 46 are bonded together at both sides through the post heat-seal process. The upper end (edge 46) and the lower end (edge 46) of FIG. 4A are not bonded together in the post heat-seal process. Accordingly, an opening 48*a* is created which functions as a slit for loading the product.

FIG. 5B is a side view of the air-packing device 40*b* involved in the post-heat sealing process for forming the air-packing device of FIG. 6B from the air-packing device in the sheet like shape shown in FIG. 4B. The sheet form of the air-packing device 40*b* is folded and the edges 46 are bonded together at both sides as well as between the upper and lower ends of FIG. 4B through the post heat-seal process. During the post heat-seal process, the film 49 for prohibiting the thermal bonding is inserted between the edges 46 at one side. Thus, the edges corresponding to the film 49 are not bonded together in the post heat-seal process. Accordingly, an opening 48*b* is created which functions as a slit for loading the product.

FIG. 6A is a perspective view showing an example of structure of the air-packing device 40*a* in the resent invention corresponding to FIGS. 4A and 5A. The air-packing device 40*a* of FIG. 6A is formed by supplying the air after the folding and post heat-sealing process of FIG. 5A. The air-packing device 40*a* has an inner space for packing a product therein and an opening 48*a* which is a slit for loading the product therethrough. As noted above, the opening 48*a* is created by not heat-sealing the upper and lower ends of FIG. 4A. In the example of FIG. 6A, the opening 48*a* is established on the upper (or lower) surface of the air-packing device 40*a*.

FIG. 6B is a perspective view showing an example of structure of the air-packing device 40*b* in the present invention corresponding to FIGS. 4B and 5B. The air-packing device 40*b* of FIG. 6B is formed by supplying the air after the folding and heat-sealing process of FIG. 5B. The air-packing device 40*b* has an inner space for packing a product therein and an opening 48*b* which is a slit for loading the product therethrough. In the example of FIG. 6B, the opening 48*b* is established on the side surface of the air-packing device 40*b*. The opening 48*b* is created by prohibiting the part of the side edge 46 from the heat-sealing with use of the film 49 as noted above.

Figure 7A:
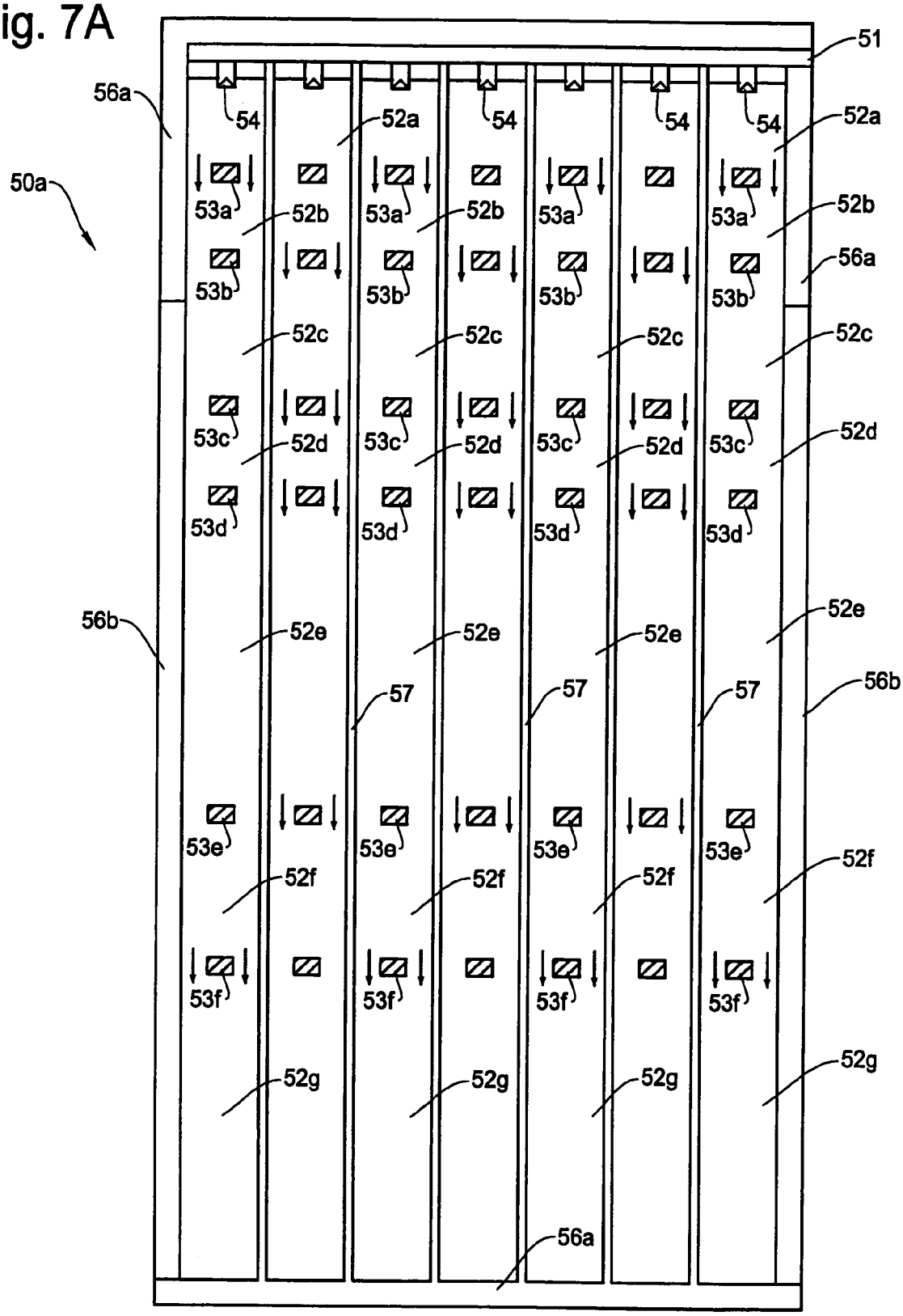
FIGS. 7A and 7B are plan views each showing a sheet like structure of the air-packing device before folding and applying a post heat-sealing process for creating generally cylindrical shape of the air packing device of FIGS. 8A an 8B, respectively.
Figure 8A:
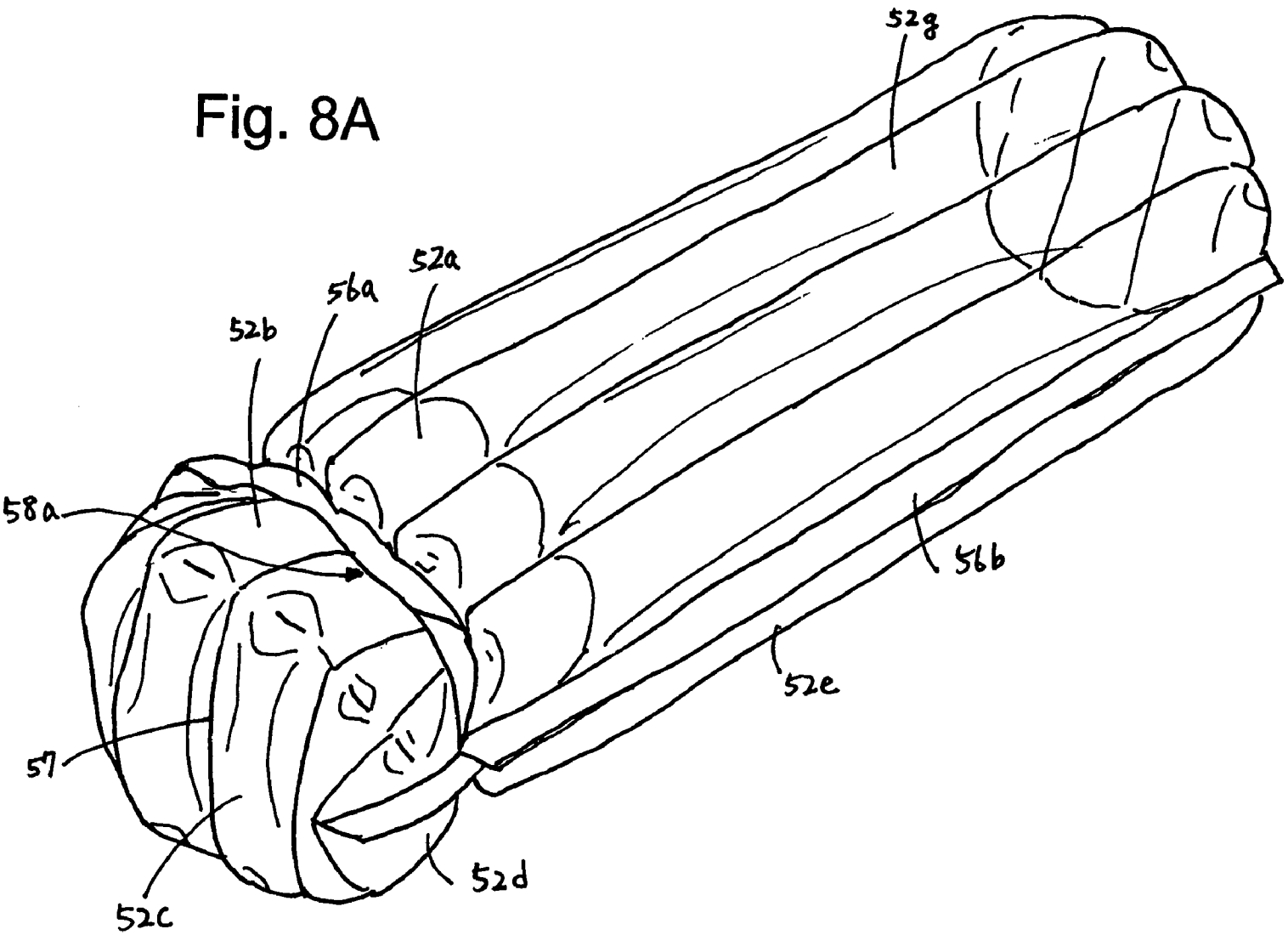
FIGS. 8A and 8B are perspective views showing examples of structure of the air-packing device in the present invention where the air-packing device of FIG. 8A corresponds to the sheet of FIG. 7A and the air-packing device of FIG. 8B corresponds to the sheet of FIG. 7B.

FIG. 7A is a plan view showing a sheet like structure of the air-packing device before folding and applying a post heat-sealing process for creating a generally cylindrical shape of the air-packing device of FIG. 8A. As will be described later, the air-packing device of FIG. 8A has an opening for loading a product therein formed by an upper end and a lower end, i.e., two longitudinal ends of the air-packing device 50*a* of FIG. 7A. Such a loading slit is formed on an upper (lower) surface of the air-packing device 50*a* of FIG. 8A by not heat-sealing the upper and lower ends in the post heat-seal process.

As shown in FIG. 7A, the air-packing device 50*a* has many sets of air containers each having a check valve 54 and series connected air cells 52*a*–52*g*. An example of structure of the check valve 54 is shown in FIGS. 9, 10A–10B and 11 which will be described in detail later. An air input 51 is commonly connected to all of the check valves 54 so that the air is supplied to each set of air cells 52*a*–52*g* through the check valve 54.

Similar to the examples of FIGS. 3 and 4A–4B, and as will be described in more detail later, the air-packing device 50*a* is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 56*b* (but not edges 56*a*) and each boundary 57 between two sets of series connected air cells after the check valve sheet is inserted therein.

The first and second thermoplastic films are also heat-sealed at locations (heat-seal lands) 53*a*–53*f* for folding the air-packing device 50*a*. Thus, the heat-seal lands 53*a*–53*f* close the first and second thermoplastic films at their locations but still allow the air to pass toward the next air cells as shown by the arrows at both sides of each heat-seal land 53. Since the portions at the heat-seal lands 53 are closed, each air container 52 is shaped like a sausage when inflated. In other words, the air-packing device 50*a* can be easily bent or folded at the heat-seal lands 53 to match the shape of the product to be protected.

Figure 7B:
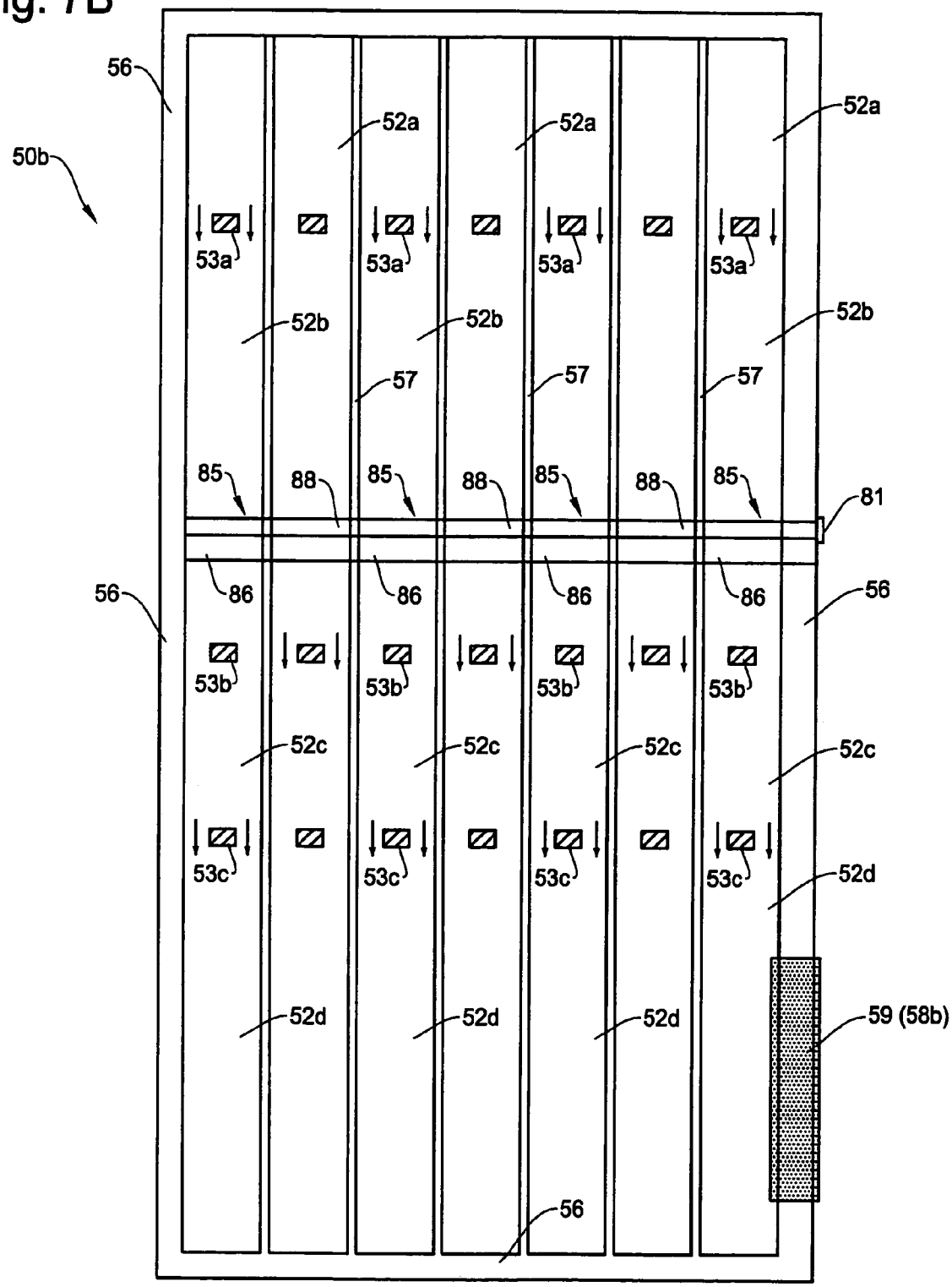
Figure 8B:
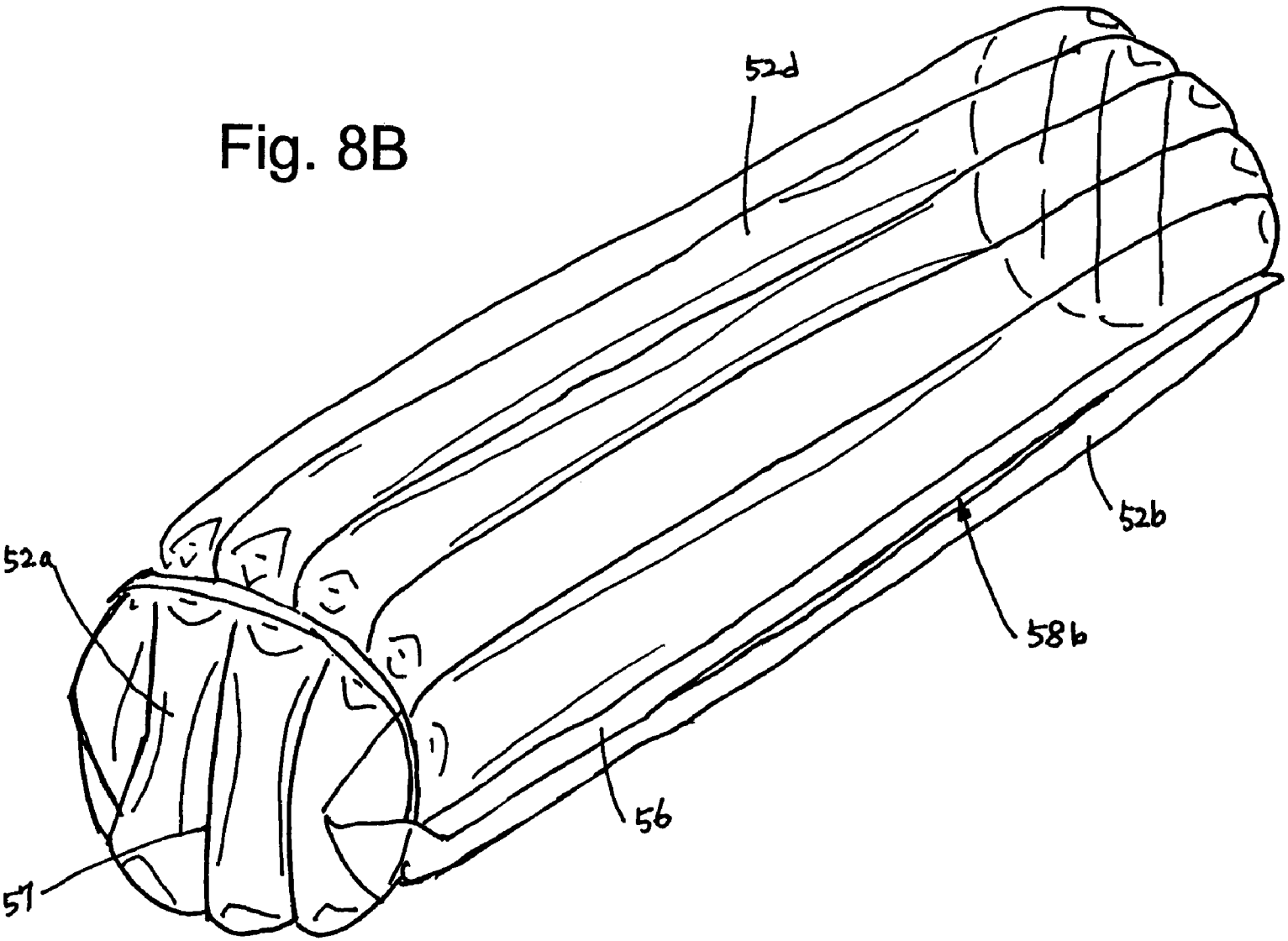

FIG. 7B is a plan view showing a sheet like structure of the air-packing device 50*b* before folding and applying a post heat-sealing process for creating a generally cylindrical shape of the air packing device 50*b* of FIG. 8B. As will be described later, the air-packing device of FIG. 8B has an opening (loading slit) 58*b* for loading a product therein formed by incorporating a film for prohibiting the thermal bonding at one edge of the air-packing device 50*b*. Such a loading slit is formed on a side surface of the air-packing device 50*b* of FIG. 8B by not heat-sealing a part of the side edges in the post heat-seal process.

In this example, elements identical to that of FIG. 7A are denoted by the same reference numbers. As shown in FIG. 7B, the air-packing device 50*b* has many sets of air containers each having series connected air cells 52*a*–52*d*. Check valves 85 are provided on the air-packing device 50*b* at any desired locations thereof. A film 59 is provided on the side edge 56 to prohibit the bonding of the side edge 56 in the post heat-seal process for forming the loading slit (opening) 58*b*. As noted above, a Teflon film or a Mylar film can be used for such a purpose. Further, a type of paint (peeling agent) that interferes the bonding between the two thermoplastic films can also be used. An example of structure of the check valve 85 is shown in FIGS. 12A–12D, 13–14 and 15A–15B which will be described in detail later.

An air input 81 is commonly connected to the first check valve 85 so that the air is supplied to each set of air cells 52*a*–52*d*.

FIG. 8A is a perspective view showing an example of structure of the air-packing device 50*a* in the resent invention corresponding to FIG. 7A. The air-packing device 50*a* of FIG. 8A is formed by supplying the air after the folding and heat-sealing process of FIG. 7A. The air-packing device 50*a* has an inner space for packing a product therein and an opening 58*a* which is a slit for loading the product therethrough. In the example of FIG. 8A, the opening 58*a* is established on the upper (or lower) surface of the air-packing device 50*a*. The packing device of FIG. 8A is useful for packing a cylindrically shaped product such as a wine bottle. Preferably, in the post heat-seal process, the side edges 56*b* are bonded after being folded while other edges 56*a* are not bonded. As a result, the portion corresponding to the air cells 52*a* can be inserted in the inner opening of the air-packing device 50*a*, thereby enabling to pack the neck portion of the wine bottle.

FIG. 8B is a perspective view showing an example of structure of the air-packing device 50*b* in the resent invention corresponding to FIG. 7B. The air-packing device 50*b* of FIG. 8B is formed by supplying the air after the folding and heat-sealing process. The air-packing device 50*b* has an inner space for packing a product therein and an opening 58*b* which is a slit for loading the product therethrough. In the example of FIG. 8B, the opening 58*b* is established on the side surface of the air-packing device 50*b*. The opening 58*b* is created by prohibiting the part of the side edge 56 from being heat-sealed with use of the film 59 in FIG. 7B as noted above.

Figure 9:
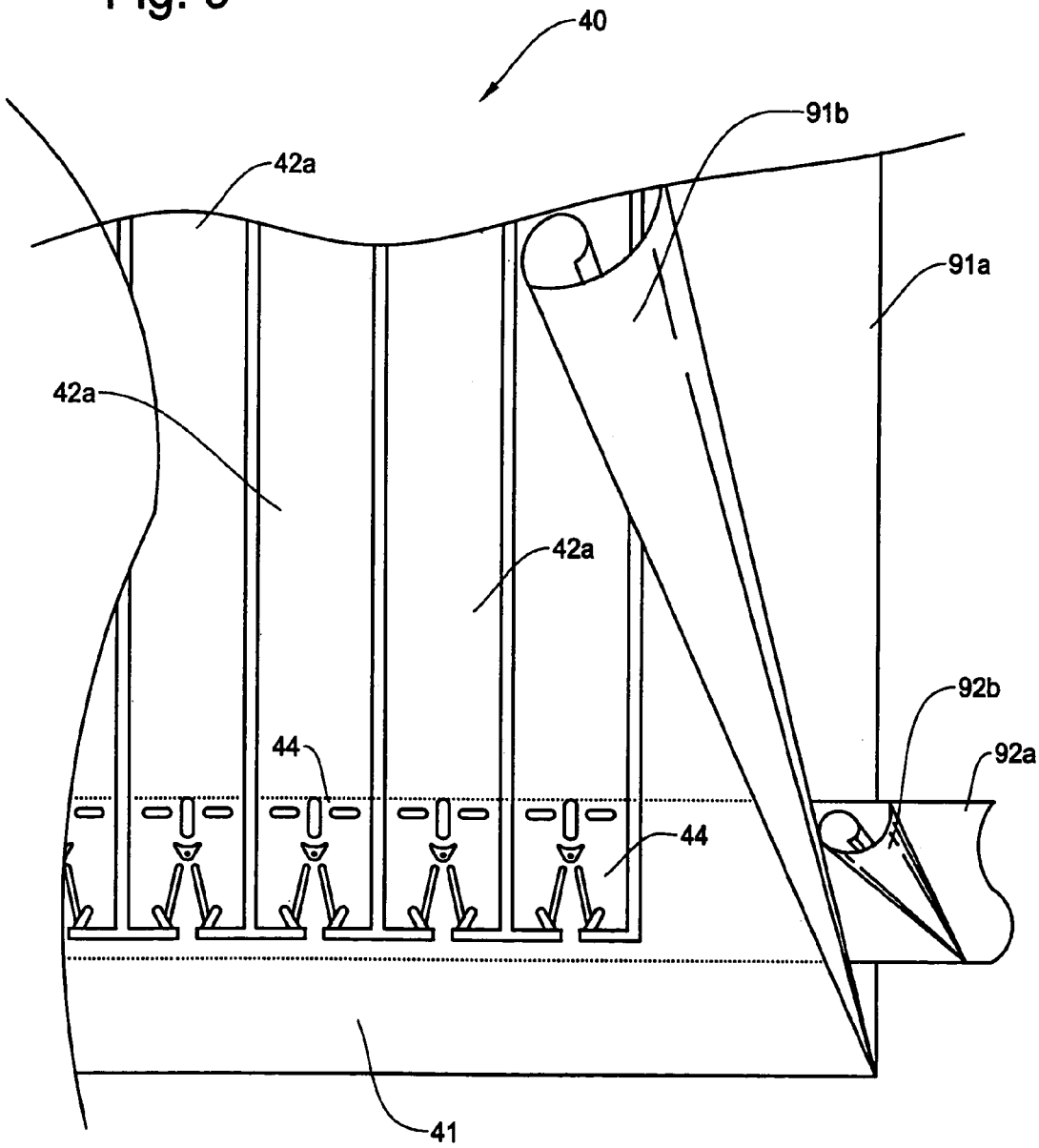
FIG. 9 is a plan view showing an example of detailed structure of the air-packing device of the present invention in the area of the check valve.

FIG. 9 is a plan view showing an example of detailed structure of the air-packing device of the present invention in the area of the check valve. The following explanation is made for showing the structure of the air-packing device 40*a* having the check valves 44 in the example of FIGS. 4A, 5A and 6A. Basically, the air-packing device 40*a* is made of three thermoplastic films; first and second air-packing films 91*a*–91*b* and a check valve film 92. The check valve film 92 in this example is configured by two thermoplastic films 92*a* and 92*b* although a single film is also possible to form a check valve. These thermoplastic films are bonded together by the heat-seal process to produce a sheet of air-packing device 40*a* as shown in FIG. 4A. Thus, the films at the edges 46 and boundaries 47 shown in FIG. 4A are air-tightly bonded together. Then, as noted above, the post heat-sealing treatment is applied to the air-packing device 40*a* to create the final form of air-packing device 40*a* shown in FIG. 6A.

Figure 10A:
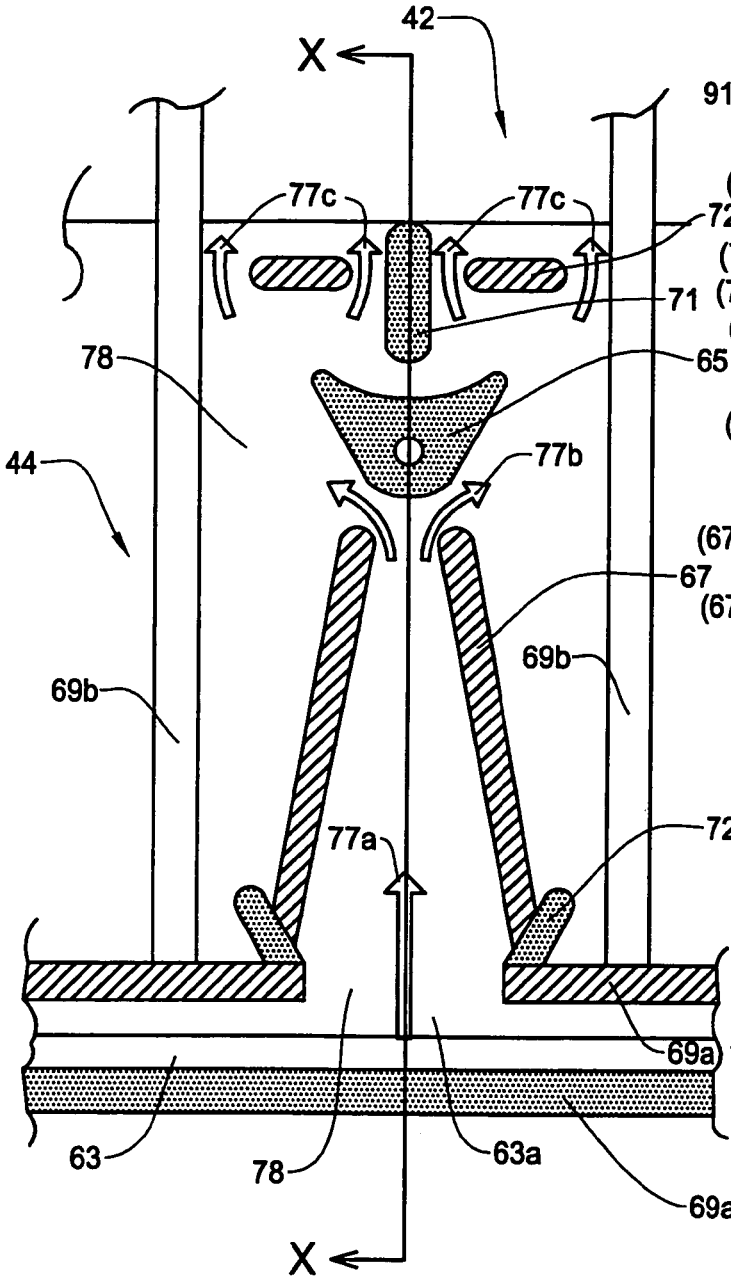
FIGS. 10A–10B are schematic diagrams showing an example of a bonding structure of the check-valve in the present invention in more detail.
Figure 10B:
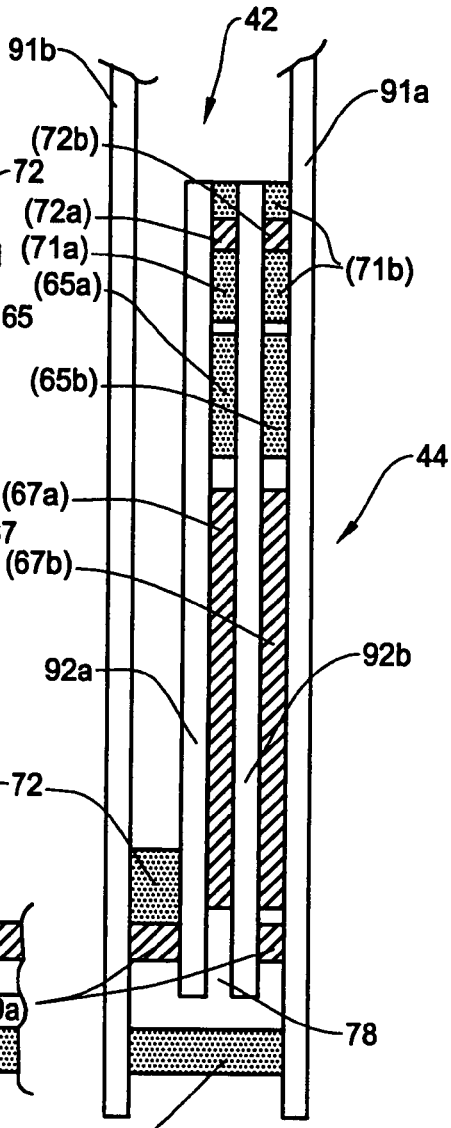

FIGS. 10A and 10B show the structure of the check valve 44 of the present invention in more detail. FIG. 10A is a top view of the check valve 44 and FIG. 10B is a cross sectional side view of the check valve 44 taken along the line X—X in FIG. 10A. Further, the cross sectional view of FIG. 10B shows the case where the compressed air is not supplied to the air container (air cells 42) in the air-packing device 40*a*.

In the example of FIGS. 10A and 10B, reinforcing seal portions 72 are formed near a check valve inlet 63*a*. These portions are placed in a manner of contacting each edge of the inlet portion 63*a*. The seal portions 72 are provided to reinforce a boundary between the guide passage 63 and the air container (air cells 42) so as to prevent the air container from a rupture when it is inflated. In the check valve of the present invention, the reinforcing seal portions 72 are preferable but not-essential and thus can be omitted.

In the air-packing device 40*a*, the two check valve films 92*a* and 92*b* are juxtaposed (superposed) and sandwiched between the two air-packing films 91*a* and 91*b* near the guide passage 63, and fixing seal portions 71–72, 65 and 67. The fixing seal portions 71–72 are referred to as outlet portions, the fixing seal portion 65 is referred to as an extended (or widened) portion, and the fixing seal portion 67 is referred to as a narrow down portion. These fixing seal portions also form the structure of the check valve 44 and fix the valve to the first air-packing film 91*a* at the same time. The fixing seal portions 65 are made by fusing the check valve films 92*a* and 92*b* only with the first air-packing film 91*a*.

The check valve 44 is made of the two check valve films (thermoplastic films) 92*a*–92*b* by which an air pipe (passage) 78 is created therebetween. How the air passes through the check valve 44 is shown by arrows denoted by the reference numbers 77*a*, 77*b* and 77*c* in FIG. 10A. The compressed air is supplied from the guide passage 63 through the air pipe 78 to the air container (air cells 42).

Figure 11:
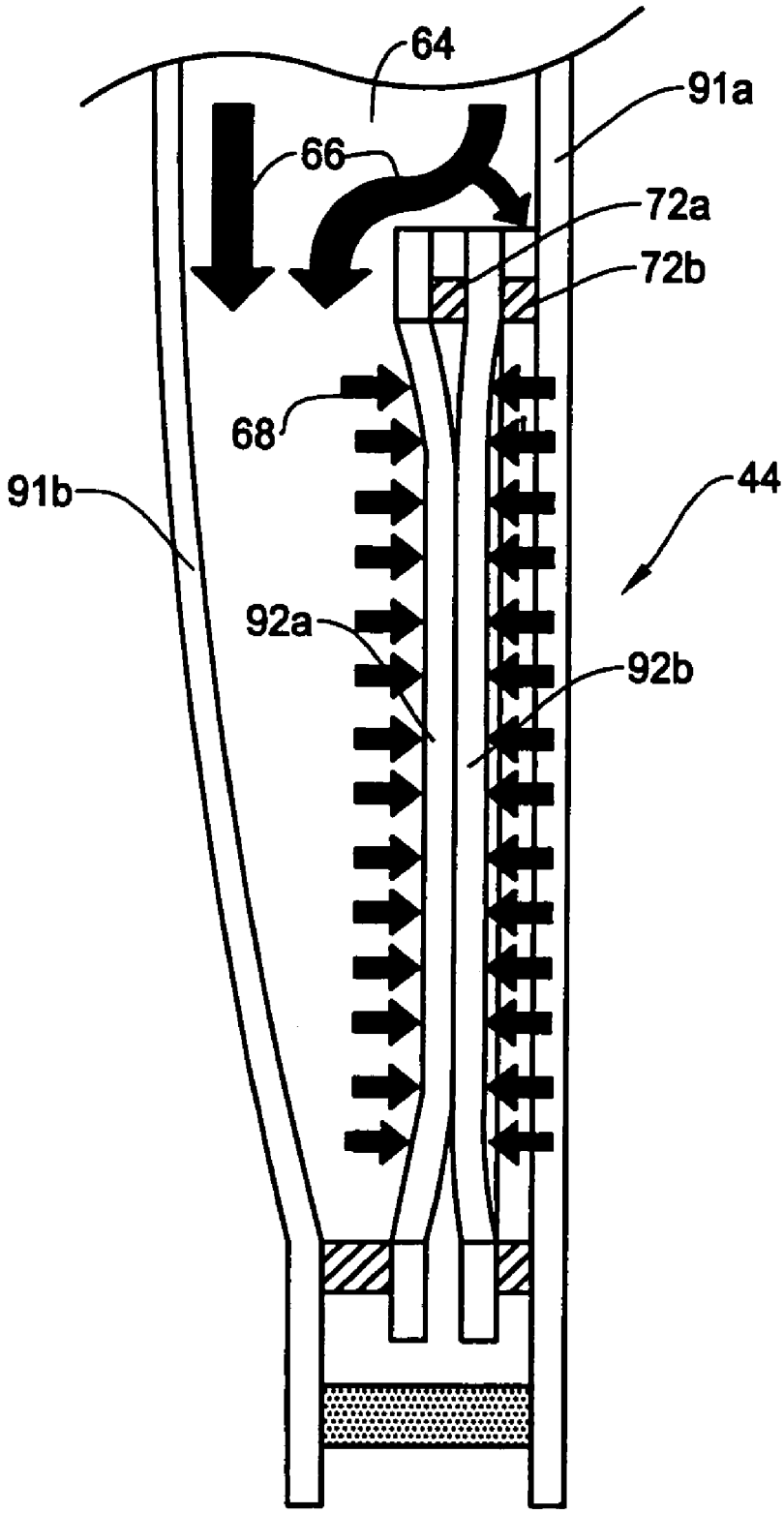
FIG. 11 is a schematic diagram showing the cross sectional view of the check valve of the present invention for explaining how the two check valve films in pairs are tightly closed when the reverse air flow happens.

In the check valve 44, the regular air relatively easily flows through the air pipe 78 although there exist the fixing seal portions 65, 67 and 71–72. However, the reverse flow of the air in the valve will not pass through the air pipe 78. In other words, if the reverse flow occurs in the air pipe 78, it is prevented because of a pressure of the reverse flow itself. By this pressure, the two surfaces of check valve films 92*a* and 92*b* which face each other, are brought into tight contact as shown in FIG. 11 as will be explained later.

As has been described, in FIGS. 10A–10B, the fixing seal portions 65, 67 and 71–72 also work for guiding the air to flow in the check valve 44. The fixing seal portions are comprised of the portions 71*a*, 72*a*, 65*a* and 67*a* which bond the two check-valve films 92*a* and 92*b* together, and the portions 71*b*, 72*b*, 65*b* and 67*b* which bond the first air-packing film 91*a* and the first check valve film 92*b* together. Accordingly, the air pipe 78 in the check valve 44 is created as a passage formed between the two check valve films 92*a*–92*b*.

Further in FIG. 10A, the fixing seal portions 67 are composed of two symmetric line segments extended in an upward direction of the drawing, and a width of the air pipe 78 is narrowed down by the fixing seal portions (narrow down portions) 67. In other words, the regular flow can easily pass through the air pipe 78 to the air cell 42 when passing through the wide space to the narrow space created by the narrow down portions 67. On the other hand, the narrow down potions 67 tend to interfere the reverse flow from the air cells 42 when the air goes back through the narrow space created by the narrow down portions 67.

The extended portion 65 is formed next to the narrow down portions 67. The shape of the extended portion 65 is similar to a heart shape to make the air flow divert. By passing the air through the extended portion 65, the air diverts, and the air flows around the edge of the extended portion 65 (indicated by the arrow 77*b*). When the air flows toward the air cells 42 (forward flow), the air flows naturally in the extended portion 65. On the other hand, the reverse flow cannot directly flow through the narrow down portions 67 because the reverse flow hits the extended portion 65 and is diverted its direction. Therefore, the extended portion 65 also functions to interfere the reverse flow of the air.

The outlet portions 71–72 are formed next to the extended portion 65. In this example, the outlet portion 71 is formed at the upper center of the check valve 44 in the flow direction of the air, and the two outlet portions 72 extended to the direction perpendicular to the outlet portion 71 are formed symmetrically. There are several spaces among these outlet portions 71 and 72. These spaces constitute a part of the air pipe 78 through which the air can pass as indicated by the arrows 77*c*. The outlet portions 71–72 are formed as a final passing portion of the check valve 44 when the air is supplied to the air container (air cells 42) and the air diverts in four ways by passing through the outlet portions 71–72.

As has been described, the flows of air from the guide passage 63 to the air cells 42 is relatively smoothly propagated through the check valve 44. Further, the narrow down portions 67, extended portions 65 and outlet portions 71–72 formed in the check valve 44 work to interfere the reverse flow of the air. Accordingly, the reverse flow from the air cells 42 cannot easily pass through the air pipe 78, which promotes the process of supplying the air in the air-packing device.

FIG. 11 is a cross sectional view showing an effect of the check valve 44 of the present invention. This example shows an inner condition of the check valve 44 when the reverse flow tries to occur in the air-packing device when it is sufficiently inflated. First, the air can hardly enter the air pipe 78 because the outlet portions 71 and 72 work against the air such that the reverse flow will not easily enter in the outlet portions. Instead, the air flows in a space between the second air-packing film 91*b* and the second check valve film 92*a* as indicated by the arrows 66, and the space is inflated as shown in FIG. 11. By this expansion, in FIG. 11, the second check valve film 92*a* is pressed to the right, and at the same time, the first check valve film 92*b* is pressed to the left. As a result, the two check valve films 92*a* and 92*b* are brought into tight contact as indicated with the arrows 68. Thus, the reverse flow is completely prevented.

Figure 12A:
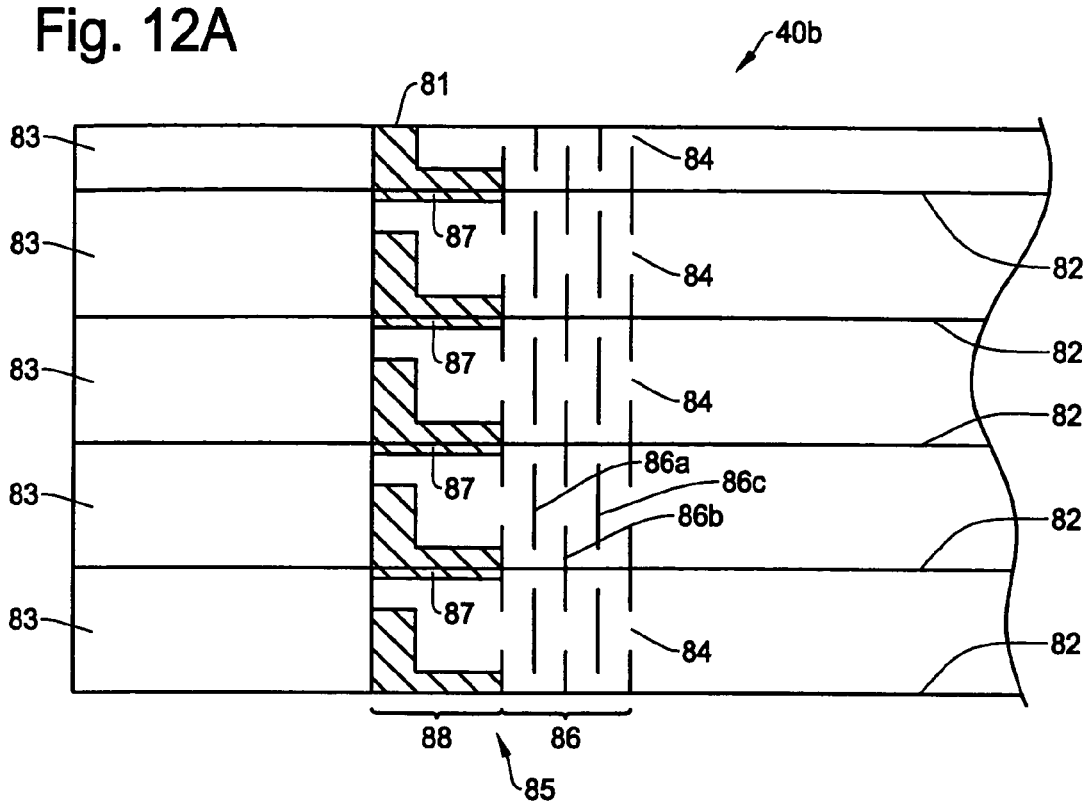
FIGS. 12A–12D show another example of the check valve of the present invention where

Another example of the check valve of the present invention is described in detail with reference to FIGS. 12A–12D, 13–14 and 15A–15B. FIGS. 12A–12D are plan views of the check valve used in the air-packing devices 40*b* and 50*b* of the present invention described above. FIG. 12A shows a structure of a check valve 85 and a portion of the air-packing device 40*b*. The air-packing device 40*b* having the check valves 85 is comprised of two or more rows of air cells 83 which are equivalent to the air cells 42*a*–42*d* in FIG. 4B. As noted above, typically, each row of air container has a plurality of series connected air cells 83 although only one air cell is illustrated in FIG. 12A.

Before supplying the air, the air-packing device 40*b* is in a form of an elongated rectangular sheet made of a first (upper) thermoplastic film 93 and a second (lower) thermoplastic film 94. To create such a structure, each set of series air cells are formed by bonding the first thermoplastic film (air packing film) 93 and the second thermoplastic film (air packing film) 94 by the sealing line (boundary line) 82. Consequently, the air cells 83 are created so that each set of series connected air cells can be independently filled with the air.

Figure 12B:
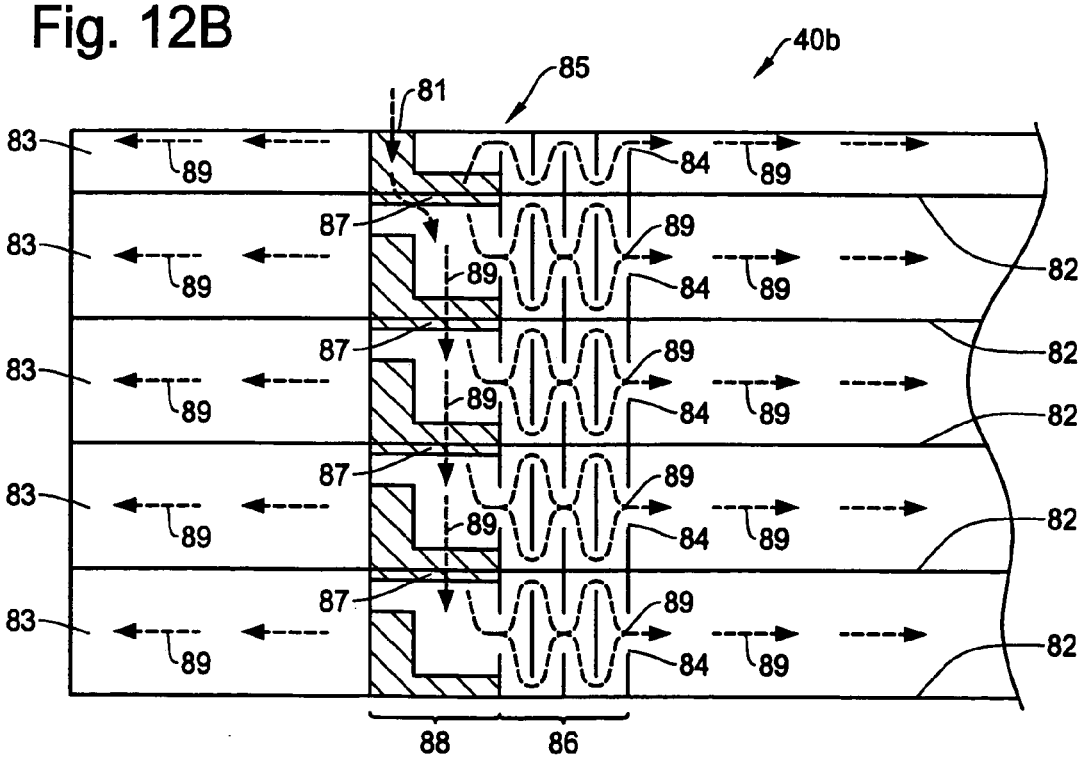
Figure 12C:
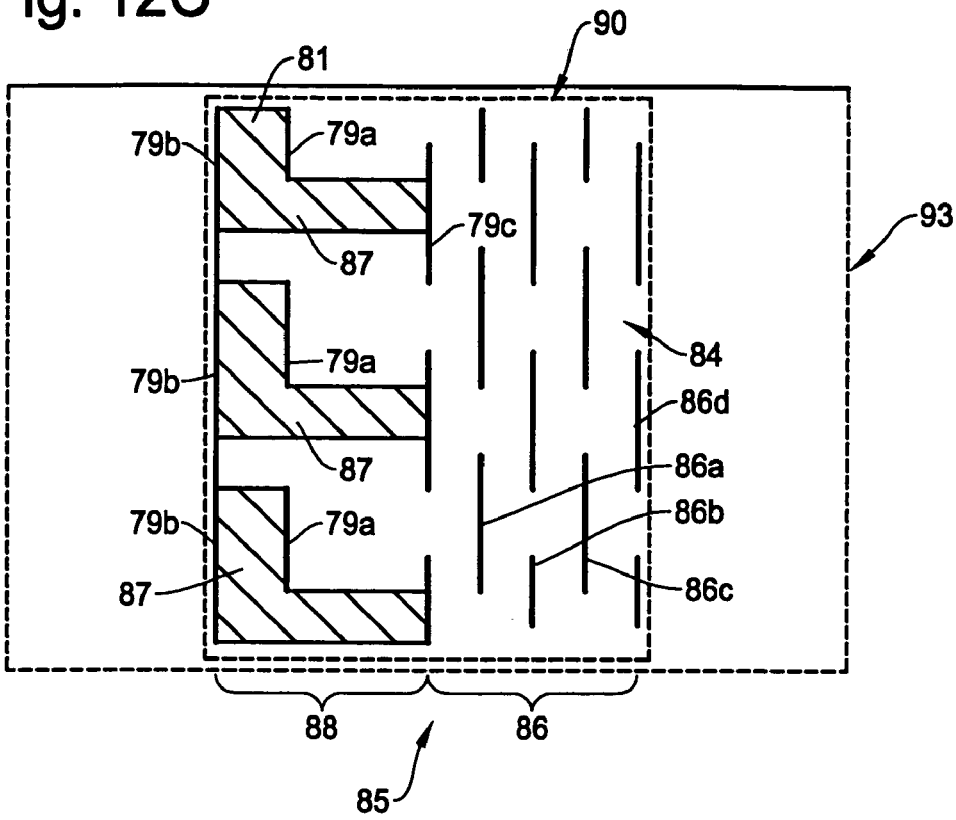

A check valve film 90 having a plurality of check valves 85 is attached to one of the thermoplastic films 93 and 94 as shown in FIG. 12C. When attaching the check valve film 90, peeling agents 87 are applied to the predetermined locations on the sealing lines 82 between the check valve film 90 and one of the thermoplastic films 93 and 94. The peeling agent 87 is a type of paint having high thermal resistance so that it prohibits the thermal bonding between the first and second thermoplastic films 93 and 94. Accordingly, even when the heat is applied to bond the first and second thermoplastic films 93 and 94 along the sealing line 82, the first and second thermoplastic films 93 and 94 will not adhere with each other at the location of the peeling agent 87.

The peeling agent 87 also allows the air input 81 to open easily when filling the air in the air-packing device 40*b*. When the upper and lower films 93 and 94 made of identical material are layered together, there is a tendency that both films stick to one another. The peeling agent 87 printed on the thermoplastic films prevents such sticking. Thus, it facilitates easy insertion of an air nozzle of the air compressor into the air input 81 when inflating the air-packing device.

The check valve 85 of the present invention is configured by a common air duct portion 88 and an air flow maze portion 86. The air duct portion 88 acts as a duct to allow the flows of the air from the air input 81 to each set of air cells 83. The air flow maze portion 86 prevents free flow of air between the air-packing device 40*b* and the outside, i.e., it works as a brake against the air flows, which makes the air supply operation easy. To achieve this brake function, the air flow maze portion 86 is configured by two or more walls (heat-seals) 86*a*–86*c*. Because of this structure, the air from the common air duct portion 88 will not straightly or freely flow into the air cells 83 but have to flow in a zigzag manner. At the end of the air flow maze portion 86, an exit 84 is formed.

In the air-packing device 40*b* incorporating the check valve 85 of the present invention, the compressed air supplied to the air input 81 to inflate the air cells 83 flows in a manner as illustrated in FIG. 12B. The plan view shown in FIG. 12B includes the structure of the check valve 85 identical to that of FIG. 12A and further includes dotted arrows 89 showing the flows of the air in the check valve 85 and the air cells 83. As indicated by the arrows 89, the air from the check valve 85 flows both forward direction and backward direction of the air-packing device 40*b*. Thus, the check valve 85 can be formed at any locations of the air-packing device 40*b*. Further, the check valve 85 requires a relatively low pressure of the air compressor when it is attached to an intermediate location of the air-packing device 40*b*.

In FIG. 12B, when the air is supplied to the air input 81 from the air compressor (not shown), the air flows toward the exit 84 via air duct portion 88 and the air flow maze portion 86 as well as toward the next adjacent air cell 83 via the air duct portion 88. The air exited from the exit 84 inflates the air cell 83 by flowing both forward and backward directions (right and left directions of FIG. 12B) of the air-packing device 40*b*. The air transferred to the next air cell flows in the same manner, i.e., toward the exit 84 and toward the next adjacent air cell 83. Such operations continue from the first air cell 83 to the last air cell 83. In other words, the air duct portion 88 allows the air to flow to either the present air cell 83 through the air flow maze portion 86 and to the next air cell 83.

Figure 12D:
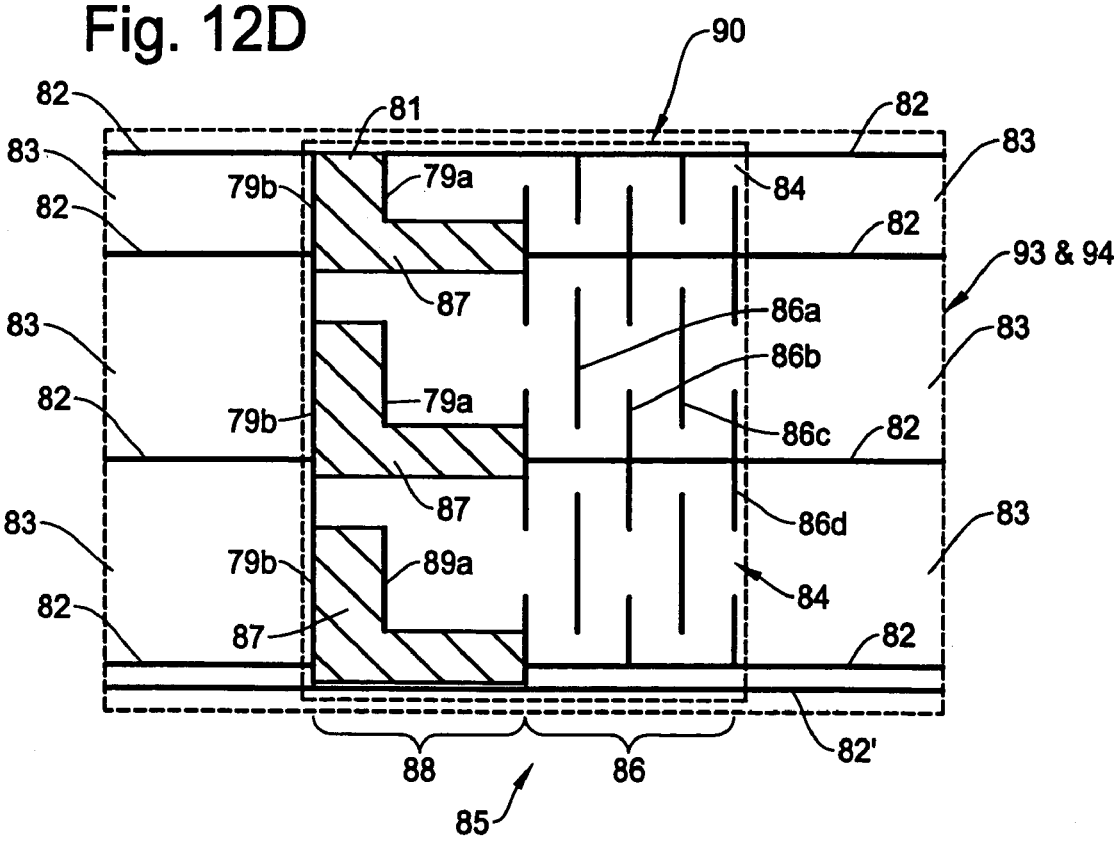

FIGS. 12C–12D show an enlarged view of the check valve of the present invention for explaining how the check valves 85 are created on the air-packing device 40*b*. As noted above, the check valve film 90 is attached to either one of the thermoplastic film 93 or 94. The example of FIGS. 12C and 12D show the case where the check valve film 90 is attached to the upper (first) thermoplastic film 93. The thick lines in the drawings indicate the heat-seal (bonding) between the thermoplastic films.

The air-packing device of the present invention is manufactured by bonding the second (lower) thermoplastic film 94, the check valve film 90, and the first (upper) thermoplastic film 93 by pressing the films with a heater. Since each film is made of thermoplastic material, they will bond (welded) together when heat is applied. In this example, the check valve film 90 is attached to the upper thermoplastic film 93, and then, the check valve film 90 and the upper thermoplastic film 93 are bonded to the lower thermoplastic film 94.

First, as shown in FIG. 12C, the check valve film 90 is attached to the upper thermoplastic film 93 by heat-sealing the two films at the portions indicated by the thick lines. Through this process, the peeling agents 87 applied in advance to the check valve film 90 is attached to the upper thermoplastic film 93 by the bonding lines 79*a* and 79*b* to create the air duct portions 88. Further, the air flow maze portions 86 are created by the bonding lines 86*a*–86*c*, etc. At the end of the maze portion 86 is opened to establish the air exit 84.

Then, as shown in FIG. 12D, the check valve film 90 and the upper thermoplastic film 93 are attached to the lower thermoplastic film 94 by heat-sealing the upper and lower films at the portions indicated by the thick lines 82. Through this process, each air cell 83 is separated from one another because the boundary between the two air cells is closed by the sealing line (boundary line) 82. However, the range of the sealing line 82 having the peeling agent 87 is not closed because the peeling agent prohibits the heat-sealing between the films. As a result, the air duct portion 88 is created which allows the air to flow in the manner shown in FIG. 12B.

Figure 13:
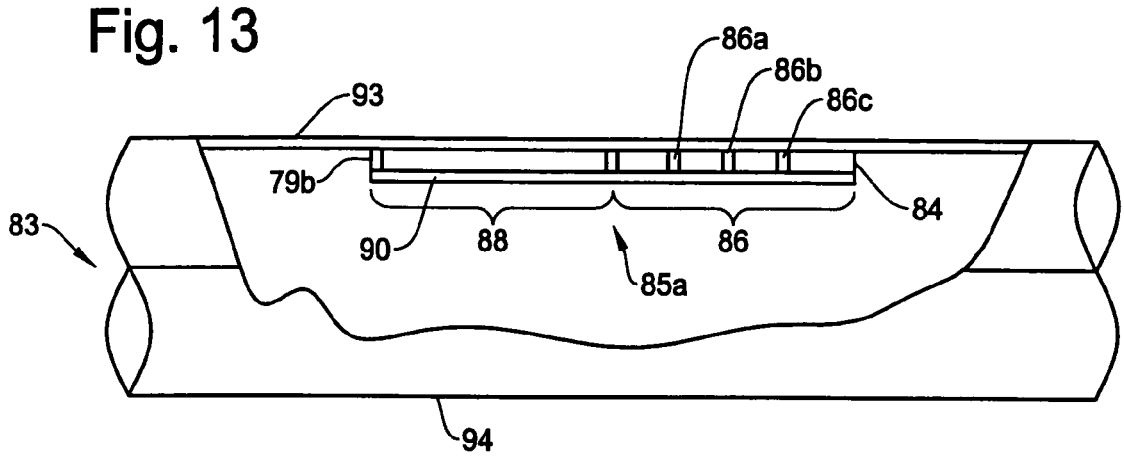
FIG. 13 is a cross sectional view showing an example of inner structure of the check valve in the present invention configured by a single layer film and formed on one of the thermoplastic films of the air-packing device.

FIG. 13 is a partial cross sectional front view showing an example of inner structure of the check valve 85*a* of the present invention configured by a single layer film and formed on a thermoplastic film of the air-packing device. As described in the foregoing, the common air duct portion 88 and the air flow maze portion 86 are created between the check valve film 90 and one of the upper and lower thermoplastic films 93 and 94. In this example, the check valve film 90 is attached to the upper thermoplastic film 93 through the heat-sealing in the manner described with reference to FIG. 12C.

The air flow maze portion 86 has a maze structure such as a zig-zaged air passage to cause resistance to the air flow such as reverse flow. Such a zig-zaged air passage is created by the bonding (heat-sealed) lines 86*a*–86*c*. Unlike the straight forward air passage, the maze portion 86 achieves an easy operation for inflating the air-packing device by the compressed air. Various ways for producing the resistance of the air flow are possible, and the structure of the maze portion 86 shown in FIGS. 12A–12D and 13 is merely one example. In general, the more complex the maze structure, the less area of the maze portion 86 is necessary to adequately produce the resistance against the air flow.

Figure 14:
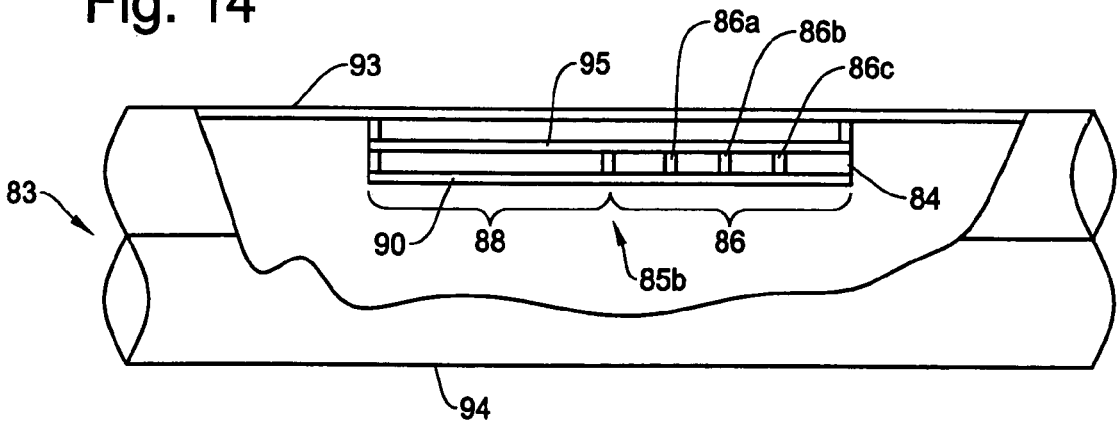
FIG. 14 is a cross sectional view showing another example of the inner structure of the check valve in the present invention configured by double layer films and formed on one of the thermoplastic films of the air-packing device.

FIG. 14 is a cross sectional view showing another example of the inner structure of the check valve 85*b* in the present invention configured by double layer films and formed on one of the thermoplastic films of the air-packing device. In this example, an addition film 95 is provided between the upper thermoplastic film 93 and the check valve film 90. The additional film 95 and the check valve film 90 forms the check valves 85*b*. The additional film 95 is so attached to the upper thermoplastic film 93 that the space between the upper thermoplastic film 93 and the additional film 95 will not transmit air.

The advantage of this structure is the improved reliability in preventing the reverse flows of air. Namely, in the check valve of FIG. 13, when the air is filled in the air cell 83, the upper thermoplastic film 93 of the air cell having the check valve 85 is curved. Further, when a product is loaded in the air-packing device, the surface projection of the product may contact and deform the outer surface of the air cell having the check valve therein. The sealing effect created by the check valve can be weakened because of the curvature of the air cell. The additional film 95 in FIG. 14 mitigates this problem since the film 95 is independent from the upper thermoplastic film 93.

Figure 15A:
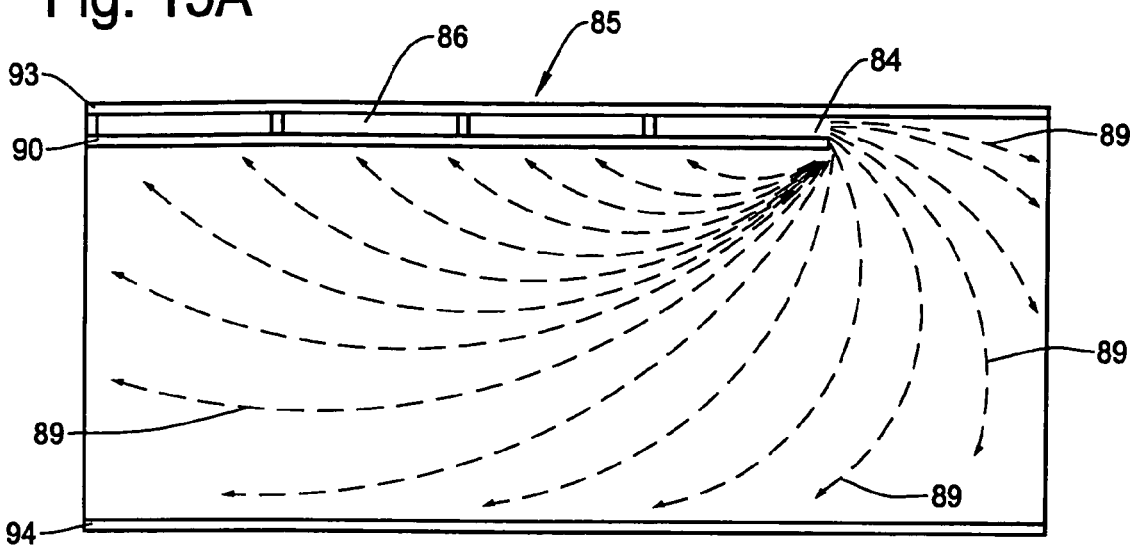
FIG. 15A is a cross sectional view showing the inner structure of a check valve of the present invention and air flows in the air cells of the air-packing device when inflating.
Figure 15B:
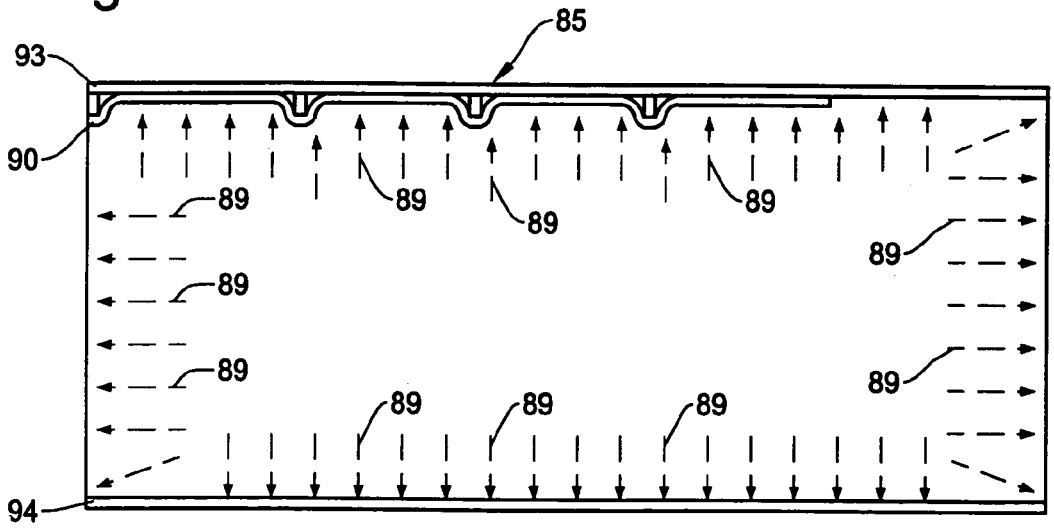
FIG. 15B is a cross section view showing the inner structure of a check valve and the air flows where the air-packing device is fully inflated so that the check valve is closed by the air pressure.

FIG. 15A and 15B are cross section views showing the inside of the air cell having the check valve 85. FIG. 15A shows the condition wherein the compressed air is being introduced into the air-packing device 40*b* through the check valve 85. FIG. 15B shows the condition where the air-packing device 40*b* is filled with air to an appropriate degree so that the check valve 85 is operated to effectively close by the inside air pressure. The dotted arrows 89 indicate the flow of air in FIGS. 15A and 15B.

As shown in FIG. 15A, when the air is pumped in from the air input 81 (FIGS. 12A–12B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 86 and exits from the exit 84 at the end of the maze portion 86. All of the air cells will eventually be filled with the compressed air.

As shown in FIG. 15B, when the air cell having the check valve 85 is inflated to a certain extent, the inner pressure of the air will push the check valve film 90 upward so that it touches the upper thermoplastic film 93. FIG. 15B mainly shows the air flow maze portion 36 of the check valve 35 to show how the check valve 85 works. When the inner pressure reaches a sufficient level, the check valve film 90 air-tightly touches the upper thermoplastic film 93, i.e., the check valve 85 is closed, thereby preventing the reverse flows of the air.

As has been described above, according to the present invention, the air-packing device can minimize a mechanical shock or vibration to the product when the product is dropped or collided. The sheet form of the air-packing device is folded and the post heat-seal treatment is applied thereto, thereby creating a structure unique to a production to be protected. The check valves in the air-packing device have a unique structure for preventing reverse flows of the air. The air-packing device of the present invention has a relatively simple structure with reliable check valves, it is able to provide a reliable air-packing device with low cost.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established at inputs of the corresponding air containers between the first and second thermoplastic films for allowing the compressed air to flow in a forward direction, the check valve being attached to only one of the first and second thermoplastic films;

an air input commonly connected to the plurality of check valves to supply the compressed air to all of the series connected air cells through the check valves; and wherein, through a post heat-seal treatment, predetermined edge portions of the air-packing device are bonded with one another after being folded, thereby creating an inner space for packing a product therein and an opening for loading the product therethrough.

2. An air-packing device as defined in claim 1, wherein the check valve is formed by sealed portions which include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

3. An air-packing device as defined in claim 2, wherein reinforcing seal portions are formed close to the inlet portion to reinforce the bonding between the check valve and one of the first and second thermoplastic films.

4. An air-packing device as defined in claim 1, wherein the check valve is comprised of:

a check valve film on which peeling agents of predetermined pattern are applied, said check valve film being attached to one of the first and second thermoplastic films;

an air input established by one of the peeling agents on the air-packing device for receiving air from an air source;

an air flow maze portion forming an air passage of a zig-zag shape, said air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range to which said peeling agent is applied.

5. An air-packing device as defined in claim 4, wherein said check valves are formed at any desired position on the air-packing device where the air from the check valve flows in both forward and backward directions in the air container to fill all of the series connected air cells therein.

6. An air-packing device as defined in claim 4, wherein an additional film is provided between the check valve film and one of said first and second thermoplastic films.

7. An air-packing device as defined in claim 4, wherein the check valve film is attached to one of said first and second thermoplastic films at any desired locations of the air-packing device.

8. An air-packing device as defined in claim 4, wherein at least the air passage in said air flow maze portion is closed by air tightly contacting the check valve film with one of said first and second thermoplastic films by air pressure within the air container when the air-packing device is filled with the compressed air to a sufficient degree.

9. An air-packing device as defined in claim 6, wherein at least the air passage in said air flow maze portion is closed by air tightly contacting the check valve film with said additional film by air pressure within the air container when the air-packing device is filled with the compressed air in a sufficient level.

10. An air-packing device as defined in claim 1, wherein said opening for loading the product is configured by two longitudinal ends which meet to one another after the air-packing device being folded.

11. An air-packing device as defined in claim 1, wherein said opening for loading the product is configured by a predetermined portion of one of side edges of the air-packing device which is created by prohibiting from being heat-sealed in said post heat-seal treatment.

12. An air-packing device as defined in claim 11, wherein a film or paint having high heat resistance is provided at said predetermined portion of one of side edges to prohibit said predetermined portion from being heat-sealed in said post heat-seal treatment.

13. An air-packing device as defined in claim 2, wherein said air input and said plurality of check valves are formed at one end of the air-packing device where the air from the air input is supplied to the series connected air cells in a direction toward another end of the air-packing device through the check valves.

14. An air-packing device as defined in claim 1, wherein said predetermined portions for bonding the first and second thermoplastic films include heat-seal lands each being formed at about a center of the air container to define said air cells, said heat-seal lands are folding points of the air-packing device when the air-packing device is inflated after the post heat-seal treatment.

15. An air-packing device as defined in claim 14, wherein each of said heat-seal lands creates two air flow passages at both sides thereof in said air container thereby allowing the compressed air to flow to the series connected air cells through the two air passages.

* * * * *